US006836194B2

(12) United States Patent
Wheeler et al.

(10) Patent No.: US 6,836,194 B2
(45) Date of Patent: Dec. 28, 2004

(54) COMPONENTS IMPLEMENTED USING LATCHING MICRO-MAGNETIC SWITCHES

(75) Inventors: Charles Wheeler, Paradise Valley, AZ (US); Jun Shen, Phoenix, AZ (US); Meichun Ruan, Tempe, AZ (US)

(73) Assignee: Magfusion, Inc., Chandler, AZ (US)

( * ) Notice: Subject to any disclaimer, the term of this patent is extended or adjusted under 35 U.S.C. 154(b) by 8 days.

(21) Appl. No.: 10/326,608

(22) Filed: Dec. 23, 2002

(65) Prior Publication Data

US 2003/0179056 A1 Sep. 25, 2003

Related U.S. Application Data

(60) Provisional application No. 60/341,876, filed on Dec. 21, 2001.

(51) Int. Cl.[7] ..... H01P 1/10
(52) U.S. Cl. ..... 333/105; 333/262
(58) Field of Search ..... 333/101, 105, 333/262; 200/181; 335/78; H01H 51/22

(56) References Cited

U.S. PATENT DOCUMENTS

| | | | | |
|---|---|---|---|---|
| 4,065,677 | A | 12/1977 | Micheron et al. | 307/112 |
| 4,461,968 | A | 7/1984 | Kolm et al. | 310/332 |
| 4,496,211 | A | 1/1985 | Daniel | 385/31 |
| 4,570,139 | A | 2/1986 | Kroll | 335/187 |
| 5,016,978 | A | 5/1991 | Fargette et al. | 359/234 |

(List continued on next page.)

FOREIGN PATENT DOCUMENTS

| | | | | |
|---|---|---|---|---|
| DE | 19820821 | C1 | 12/1999 | H01H/50/18 |
| DE | 10031569 | A1 | 2/2001 | H01H/59/00 |
| EP | 0452012 | A2 A3 | 10/1991 | G02B/26/02 |
| EP | 0685864 | A1 | 12/1995 | H01H/51/26 |
| EP | 0709911 | A2 A3 | 5/1996 | H01P/1/12 |
| EP | 0780858 | A1 | 6/1997 | H01H/1/00 |
| EP | 0887879 | A1 | 6/1998 | H01Q/3/38 |
| EP | 0869519 | A1 | 10/1998 | H01H/1/00 |
| FR | 2572546 | A1 | 5/1986 | G02B/26/08 |
| JP | 54-161952 | | 12/1979 | G02B/5/14 |
| JP | 4-275519 | | 10/1992 | G02B/26/08 |
| JP | 6-251684 | | 9/1994 | H01H/51/27 |
| WO | WO 97/39468 | | 10/1997 | H01H/51/22 |
| WO | WO 98/34269 | | 8/1998 | H01L/20/78 |
| WO | WO 9927548 | | 6/1999 | H01H/1/00 |

OTHER PUBLICATIONS

Richard P. Feymann, "There's Plenty of Room at the Bottom", Dec. 29, 1959, pp. 1–12, Internet Source: http://222.zyvex.com/nanotech/feynman.html.

E. Fullin, J. Gobet, H.A.C. Tilmans, and J. Bergvist, "A New Basic Technology for Magnetic Micro–Actuators", pp. 143–147.

(List continued on next page.)

*Primary Examiner*—Robert Pascal
*Assistant Examiner*—Dean Takaoka
(74) *Attorney, Agent, or Firm*—Sterne, Kessler, Goldstein & Fox PLLC

(57) ABSTRACT

A method and apparatus for controlling the coupling of a circuit into a signal path is described. A moveable element is supported by a substrate and has a magnetic material and a long axis. At least one magnet produces a first magnetic field. The first magnetic field induces a magnetization in the magnetic material. The magnetization is characterized by a magnetization vector pointing in a direction along the long axis of the moveable element. The first magnetic field is approximately perpendicular to a major central portion of the long axis. A coil produces a second magnetic field to switch the moveable element between first and second stable states. Only temporary application of the second magnetic field is required to change direction of the magnetization vector, which causes the moveable element to switch between the first and second stable states. In the first stable state, the moveable element does not couple the circuit in series with a signal. In the second stable state, the moveable element couples the circuit in series with the signal.

24 Claims, 15 Drawing Sheets

U.S. PATENT DOCUMENTS

| | | | | |
|---|---|---|---|---|
| 5,048,912 | A | 9/1991 | Kunikane et al. | 385/23 |
| 5,398,011 | A | 3/1995 | Kimura et al. | 335/79 |
| 5,472,539 | A | 12/1995 | Saia et al. | 156/35 |
| 5,475,353 | A | 12/1995 | Roshen et al. | 335/78 |
| 5,557,132 | A | 9/1996 | Takahashi | 257/415 |
| 5,629,918 | A | 5/1997 | Ho et al. | 310/40 MM |
| 5,696,619 | A | 12/1997 | Knipe et al. | 359/224 |
| 5,784,190 | A | 7/1998 | Worley | 359/291 |
| 5,818,316 | A | 10/1998 | Shen et al. | 335/78 |
| 5,838,847 | A | 11/1998 | Pan et al. | 385/18 |
| 5,847,631 | A | 12/1998 | Taylor et al. | 335/78 |
| 5,898,515 | A | 4/1999 | Furlani et al. | 359/290 |
| 5,982,554 | A | 11/1999 | Goldstein et al. | 359/629 |
| 6,016,092 | A | 1/2000 | Qiu et al. | 333/262 |
| 6,016,095 | A | 1/2000 | Herbert | 336/175 |
| 6,028,689 | A | 2/2000 | Michalicek et al. | 359/224 |
| 6,078,016 | A | 6/2000 | Yoshikawa et al. | 200/181 |
| 6,084,281 | A | 7/2000 | Fullin et al. | 257/422 |
| 6,094,116 | A | 7/2000 | Tai et al. | 335/78 |
| 6,094,293 | A | 7/2000 | Yokoyama et al. | 359/280 |
| 6,115,231 | A | 9/2000 | Shirakawa | 361/233 |
| 6,124,650 | A | 9/2000 | Bishop et al. | 310/40 MM |
| 6,143,997 | A | 11/2000 | Feng et al. | 200/181 |
| 6,160,230 | A | 12/2000 | McMillen et al. | 200/181 |
| 6,320,547 | B1 * | 11/2001 | Fathy et al. | 343/700 MS |
| 6,410,360 | B1 | 6/2002 | Steenberge | 438/52 |
| 6,469,602 | B2 * | 10/2002 | Ruan et al. | 335/78 |

OTHER PUBLICATIONS

Jack W. Judy and Richard S. Muller "Magnetically Actuated, Addressable Microstructures", Sep. 1997, Journal of Microelectromechanical Systems, vol. 6, No. 3, Sep. 1997, pp. 249–255.

Ezekiel JJ Kruglick and Kristofer SJ Pister, "Project Overview: Micro–Relays", Tech. Digital Solid–State Sensor and Actuator Workshop, 1998, Hilton Head 98 and 19$^{th}$ International Conference on Electric Contact Phenomena, Nuremberg, Germany, Sep. 1998 (Downloaded from Internet Source: http://www–bsac.eecs.berkeley.edu/Kruglick/relays/relays/html. on Jul. 12, 1999) 2 pgs.

Ezekiel J.J. Kruglick and Kristofer S.J. Pister, "Bistable MEMS Relays and Contact Characterization", Tech. Digital Solid–State Sensor and Actuator Workshop, Hilton Head, 1988 and 19$^{th}$ International Conference on Electric Contact Phenomena, Nuremberg, Germany, Sep. 1998, 5 pgs.

Laure K. Lagorce and Oliver Brand, "Magnetic Microactuators Based on Polymer Magnets", Mar. 1999, IEEE Journal of Microelectromechanical Systems, IEEE, vol. 8., No. 1., Mar. 1999, 8 pages.

"P10D Electricity & Magnetism Lecture 14", Internet Source: http://scitec.uwhichill.edu.bb/cmp/online/P10D/Lecture14/lect14.htn, Jan. 3, 2000, pp. 1–5.

"Ultraminiature Magnetic Latching to 5–relays SPDT DC to C Band", Series RF 341, product information from Teledyne Relays, 1998.

M. Ruan et al., "Latching Microelectromagnetic Relays", Sensors and Actuators A 91 (Jul. 15, 2001), Copyright 2001 Elsevier Science B.V., pp. 346–350.

Xi–Qing Sun, K.R. Farmer, W.N. Carr, "A Bistable Microrelay Based on Two–Segment Multimorph Cantilever Actuators", 11$^{th}$ Annual Workshop on Micro Electrical Mechanical Systems, Heidelberg, Germany, IEEE, Jan. 25–29, 1998, pp. 154–159.

William P. Taylor and Mark G. Allen, "Integrated Magnetic Microrelays: Normally Open, Normally Closed, and Multi-Pole Devices", 1997 International Conference on SolidState Sensors and Actuators, IEEE, Jun. 16–19, 1997, pp. 1149–1152.

William P. Taylor, Oliver Brand, and Mark G. Allen. "Fully Integrated Magnetically Actuated Micromachined Relays", Journal of Microelectromechanical Systems, IEEE, vol. 7, No. 2, Jun. 1998, pp. 181–191.

Tilmans, et al., "A Fully–Packaged Electromagnetic Microrelay", Proc. MEMS '99, Orlando, FL, Jan. 17–21, 1999, copyright IEEE 1999, pp. 25–30.

William Trimmer, "The Scaling of Micromechanical Devices", Internet Source: http://home.earthlink.net/–trimmerw/mems/scale.html on Jan. 3, 2000 (adapted from article Microrobots and Micromechanical Systems by W.S.N. Trimmer, Sensors and Actuators, vol. 19, No. 3, Sep. 1989, pp. 12/12, and other sources).

John A. Wright and Yu–Chong Tai, "Micro–Miniature Electromagnetic Switches Fabricated Using MEMS Technology", Proceedings: 46$^{th}$ Annual International Relay Conference: NARM '98, Apr. 1998, pp. 13–1 to 13–4.

John A. Wright, Yu–Chong Tai and Gerald Lilienthal, "A Magnetostatic MEMS Switch for DC Brushless Motor Commutation", Proceedings Solid State Sensor and Actuator Workshop, Hilton Head, 1998, Jun. 1998, pp. 304–307.

John A. Wright, Yu–Chong Tai, and Shih–Chia Chang, "A Large–Force, Fully–Integrated MEMS Magnetic Actuator", Tranducers '97, 1997 International Conference on Solid State Sensors and Actuators, Chicago, Jun. 16–19, 1997.

Ann, Chong H. & Allen, Mark G., A Fully Integrated Micromagnetic Actuator With A Multilevel Meander Magnetic Core, 1992 IEEE, Solid–State Sensor and Actuator Workshop, Technical Digest, Hilton Head Island, South Carolina, Jun. 22–25, 1992, Technical, Digest, pp. 14–17.

English–Language Abstract of DE 10031569, published Feb. 1, 2001, 1 page.

English–Language Abstract of DE 19820821, published Dec. 16, 1999, 1 page.

English–Language Abstract of EP 0780858, published Jun. 25, 1997, 1 page.

English–Language Abstract of EP 0869519, published Oct. 7, 1998, 1 page.

English–Language Abstract of FR 2572546, published May 2, 1986, 1 page.

English–Language Abstract of JP 4275519, published Oct. 1, 1992, 1 page.

English–Language Abstract of JP 6251684, published Sep. 9, 1994, 1 page.

English–Language Abstract of JP 54161952, published Dec. 22, 1979, 1 page.

English–Language Abstract of WO 9927548, published Jun. 3, 1999, 1 page.

* cited by examiner

COMPONENTS IMPLEMENTED USING LATCHING MICRO-MAGNETIC SWITCHES

CROSS-REFERENCE TO RELATED APPLICATIONS

This application claims priority to U.S. provisional Application No. 60/341,876, filed Dec. 21, 2001, which is incorporated herein by reference.

BACKGROUND OF THE INVENTION

1. Field of the Invention

The present invention relates to electronic switches. More specifically, the present invention relates to using latching micro-magnetic switches to connect circuits, such as attenuators, capacitors, phase array antenna devices, or the like, to a circuit or signal path.

2. Background Art

Switches are typically electrically controlled two-state devices that open and close contacts to effect operation of devices in an electrical or optical circuit. Relays, for example, typically function as switches that activate or de-activate portions of electrical, optical or other devices. Relays are commonly used in many applications including telecommunications, radio frequency (RF) communications, portable electronics, consumer and industrial electronics, aerospace, and other systems. More recently, optical switches (also referred to as "optical relays" or simply "relays" herein) have been used to switch optical signals (such as those in optical communication systems) from one path to another.

Although the earliest relays were mechanical or solid-state devices, recent developments in micro-electro-mechanical systems (MEMS) technologies and microelectronics manufacturing have made micro-electrostatic and micro-magnetic relays possible. Such micro-magnetic relays typically include an electromagnet that energizes an armature to make or break an electrical contact. When the magnet is de-energized, a spring or other mechanical force typically restores the armature to a quiescent position. Such relays typically exhibit a number of marked disadvantages, however, in that they generally exhibit only a single stable output (i.e., the quiescent state) and they are not latching (i.e., they do not retain a constant output as power is removed from the relay). Moreover, the spring required by conventional micro-magnetic relays may degrade or break over time.

Non-latching micro-magnetic relays are known. The relay includes a permanent magnet and an electromagnet for generating a magnetic field that intermittently opposes the field generated by the permanent magnet. The relay must consume power in the electromagnet to maintain at least one of the output states. Moreover, the power required to generate the opposing field would be significant, thus making the relay less desirable for use in space, portable electronics, and other applications that demand low power consumption.

The basic elements of a latching micro-magnetic switch include a permanent magnet, a substrate, a coil, and a cantilever at least partially made of soft magnetic materials. In its optimal configuration, the permanent magnet produces a static magnetic field that is relatively perpendicular to the horizontal plane of the cantilever. However, the magnetic field lines produced by a permanent magnet with a typical regular shape (disk, square, etc.) are not necessarily perpendicular to a plane, especially at the edge of the magnet. Then, any horizontal component of the magnetic field due to the permanent magnet can either eliminate one of the bistable states, or greatly increase the current that is needed to switch the cantilever from one state to the other. Careful alignment of the permanent magnet relative to the cantilever so as to locate the cantilever in the right spot of the permanent magnet field (usually near the center) will permit bi-stability and minimize switching current. Nevertheless, high-volume production of the switch can become difficult and costly if the alignment error tolerance is small.

What is desired are bi-stable, latching relays or switches that do not require power to hold their states. Such a switch should be reliable, simple in design, low-cost and easy to manufacture, and should be useful in optical and/or electrical environments.

BRIEF SUMMARY OF THE INVENTION

A method and apparatus for controlling the coupling of a first circuit into another circuit or signal path is described. A micro-machined latching switch (i.e., relay) of the present invention can be switched between two states. In a first state, the switch couples the first circuit into a signal path. In a second state, the switch provides a conductive path that bypasses the first circuit.

In an aspect of the present invention, a moveable element is supported by a substrate and has a magnetic material and a long axis. At least one magnet produces a first magnetic field. The first magnetic field induces a magnetization in the magnetic material. The magnetization is characterized by a magnetization vector pointing in a direction along the long axis of the moveable element. The first magnetic field is approximately perpendicular to a major central portion of the long axis. A coil produces a second magnetic field to switch the moveable element between first and second stable states. Temporary application of the second magnetic field is required to change direction of the magnetization vector, which causes the moveable element to switch between the first and second stable states. In the first stable state, the moveable element does not couple the first circuit in series with a signal. In the second stable state, the moveable element couples the first circuit in series with the signal.

The first circuit can include any number of components and component configurations. In an aspect, the first circuit is an attenuator circuit, such as a resistive attenuator circuit. In another aspect, the first circuit is a capacitive circuit. In another aspect, the first circuit is a filter circuit. In further aspects, the first circuit can be other circuit types.

In aspects of the present invention, the moveable element can include one, two, three, or more electrically conductive portions.

In one aspect, the moveable element includes first and second electrically conductive portions. In a first stable state, the first electrically conductive portion forms an electrically conductive path (e.g., a short circuit) in series with the signal. In the second stable state, the second electrically conductive portion couples a first signal line of the signal to the circuit.

In another aspect, the moveable element comprises first, second, and third electrically conductive portions. In the first stable state, the first electrically conductive portion forms an electrically conductive path in series with the signal. In the second stable state, the second electrically conductive portion couples a first signal line of the signal to an input to the circuit, and the third electrically conductive portion couples a second signal line of the signal to an output of the circuit.

In another aspect, a pair of moveable elements are used to couple the circuit into the signal path. A first signal line of the signal path is coupled to the first moveable element, and a second signal line of the signal path is coupled to the second moveable element. In the first stable state, the pair of moveable elements are electrically coupled together. Thus, in the first stable state, the circuit is not coupled into the signal path. In the second stable state, the circuit is coupled into the signal path between the moveable elements.

The latching micro-magnetic switch of the present invention can be used in a plethora of products including household and industrial appliances, consumer electronics, military hardware, medical devices and vehicles of all types, just to name a few broad categories of goods. The latching micro-magnetic switch of the present invention has the advantages of compactness, simplicity of fabrication, and has good performance at high frequencies.

These and other objects, advantages and features will become readily apparent in view of the following detailed description of the invention.

BRIEF DESCRIPTION OF THE FIGURES

The above and other features and advantages of the present invention are hereinafter described in the following detailed description of illustrative embodiments to be read in conjunction with the accompanying drawing figures, wherein like reference numerals are used to identify the same or similar parts in the similar views.

Figure 1A:
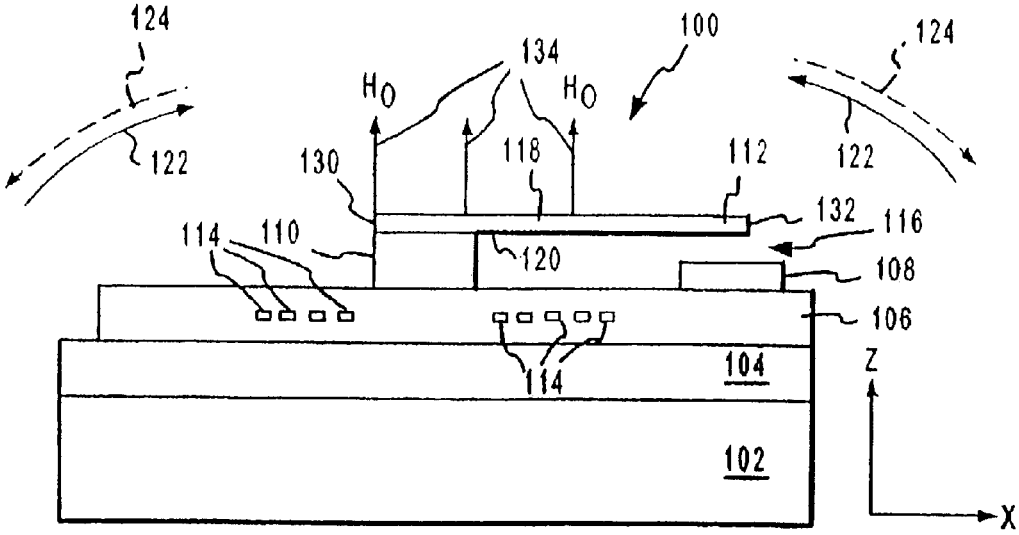
FIGS. 1A and 1B show side and top views, respectively, of an exemplary fixed-end latching micro-magnetic switch, according to an embodiment of the present invention.

The present invention will now be described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Introduction

It should be appreciated that the particular implementations shown and described herein are examples of the invention and are not intended to otherwise limit the scope of the present invention in any way. Indeed, for the sake of brevity, conventional electronics, manufacturing, MEMS technologies and other functional aspects of the systems (and components of the individual operating components of the systems) may not be described in detail herein. Furthermore, for purposes of brevity, the invention is frequently described herein as pertaining to a microelectronically-machined relay for use in electrical or electronic systems. It should be appreciated that many other manufacturing techniques could be used to create the relays described herein, and that the techniques described herein could be used in mechanical relays, optical relays or any other switching device. Further, the techniques would be suitable for application in electrical systems, optical systems, consumer electronics, industrial electronics, wireless systems, space applications, or any other application.

The terms, chip, integrated circuit, monolithic device, semiconductor device, and microelectronic device, are often used interchangeably in this field. The present invention is applicable to all the above as they are generally understood in the field.

The terms metal line, transmission line, interconnect line, trace, wire, conductor, signal path and signaling medium are all related. The related terms listed above, are generally interchangeable, and appear in order from specific to general. In this field, metal lines are sometimes referred to as traces, wires, lines, interconnect or simply metal. Metal lines, generally aluminum (Al), copper (Cu) or an alloy of Al and Cu, are conductors that provide signal paths for coupling or interconnecting, electrical circuitry. Conductors other than metal are available in microelectronic devices. Materials such as doped polysilicon, doped single-crystal silicon (often referred to simply as diffusion, regardless of whether such doping is achieved by thermal diffusion or ion implantation), titanium (Ti), molybdenum (Mo), and refractory metal silicides are examples of other conductors.

The terms contact and via, both refer to structures for electrical connection of conductors from different interconnect levels. These terms are sometimes used in the art to describe both an opening in an insulator in which the structure will be completed, and the completed structure itself. For purposes of this disclosure, contact and via refer to the completed structure.

The term vertical, as used herein, means substantially orthogonal to the surface of a substrate. Moreover, it should be understood that the spatial descriptions (e.g., "above", "below", "up", "down", "top", "bottom", etc.) made herein are for purposes of illustration only, and that practical latching relays can be spatially arranged in any orientation or manner.

The above-described micro-magnetic latching switch is further described in U.S. Pat. No. 6,469,602 (titled Electronically Switching Latching Micro-magnetic Relay And Method of Operating Same). This patent provides a thorough background on micro-magnetic latching switches and is incorporated herein by reference in its entirety.

Overview of a Latching Switch

Figure 1B:
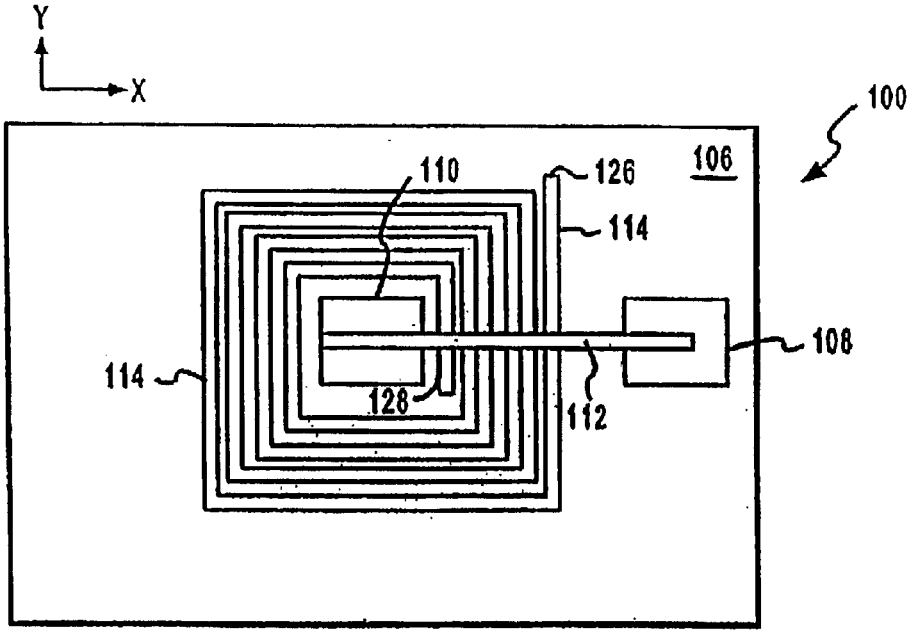

FIGS. 1A and 1B show side and top views, respectively, of a latching switch. The terms switch and device are used herein interchangeably to described the structure of the present invention. With reference to FIGS. 1A and 1B, an exemplary latching relay 100 suitably includes a magnet 102, a substrate 104, an insulating layer 106 housing a conductor 114, a contact 108 and a cantilever (moveable element) 112 positioned or supported above substrate by a staging layer 110.

Magnet 102 is any type of magnet such as a permanent magnet, an electromagnet, or any other type of magnet capable of generating a magnetic field $H_0$ 134, as described more fully below. By way of example and not limitation, the magnet 102 can be a model 59-P09213T001 magnet available from the Dexter Magnetic Technologies corporation of Fremont, Calif., although of course other types of magnets could be used. Magnetic field 134 can be generated in any manner and with any magnitude, such as from about 1 Oersted to $10^4$ Oersted or more. The strength of the field depends on the force required to hold the cantilever in a given state, and thus is implementation dependent. In the exemplary embodiment shown in FIG. 1A, magnetic field $H_0$ 134 can be generated approximately parallel to the Z axis and with a magnitude on the order of about 370 Oersted, although other embodiments will use varying orientations and magnitudes for magnetic field 134. In various embodiments, a single magnet 102 can be used in conjunction with a number of relays 100 sharing a common substrate 104.

Substrate 104 is formed of any type of substrate material such as silicon, gallium arsenide, glass, plastic, metal or any other substrate material. In various embodiments, substrate 104 can be coated with an insulating material (such as an oxide) and planarized or otherwise made flat. In various embodiments, a number of latching relays 100 can share a single substrate 104. Alternatively, other devices (such as transistors, diodes, or other electronic devices) could be formed upon substrate 104 along with one or more relays 100 using, for example, conventional integrated circuit manufacturing techniques. Alternatively, magnet 102 could be used as a substrate and the additional components discussed below could be formed directly on magnet 102. In such embodiments, a separate substrate 104 may not be required.

Insulating layer 106 is formed of any material such as oxide or another insulator such as a thin-film insulator. In an exemplary embodiment, insulating layer is formed of Probimide 7510 material. Insulating layer 106 suitably houses conductor 114. Conductor 114 is shown in FIGS. 1A and 1B to be a single conductor having two ends 126 and 128 arranged in a coil pattern. Alternate embodiments of conductor 114 use single or multiple conducting segments arranged in any suitable pattern such as a meander pattern, a serpentine pattern, a random pattern, or any other pattern. Conductor 114 is formed of any material capable of conducting electricity such as gold, silver, copper, aluminum, metal or the like. As conductor 114 conducts electricity, a magnetic field is generated around conductor 114 as discussed more fully below.

Cantilever (moveable element) 112 is any armature, extension, outcropping or member that is capable of being affected by magnetic force. In the embodiment shown in FIG. 1A, cantilever 112 suitably includes a magnetic layer 118 and a conducting layer 120. Magnetic layer 118 can be formulated of permalloy (such as NiFe alloy) or any other magnetically sensitive material. Conducting layer 120 can be formulated of gold, silver, copper, aluminum, metal or any other conducting material. In various embodiments, cantilever 112 exhibits two states corresponding to whether relay 100 is "open" or "closed", as described more fully below. In many embodiments, relay 100 is said to be "closed" when a conducting layer 120, connects staging layer 110 to contact 108. Conversely, the relay may be said to be "open" when cantilever 112 is not in electrical contact with contact 108. Because cantilever 112 can physically move in and out of contact with contact 108, various embodiments of cantilever 112 will be made flexible so that cantilever 112 can bend as appropriate. Flexibility can be created by varying the thickness of the cantilever (or its various component layers), by patterning or otherwise making holes or cuts in the cantilever, or by using increasingly flexible materials.

Although the dimensions of cantilever 112 can vary dramatically from implementation to implementation, an exemplary cantilever 112 suitable for use in a micromagnetic relay 100 can be on the order of 10–1000 microns in length, 1–40 microns in thickness, and 2–600 microns in width. For example, an exemplary cantilever in accordance with the embodiment shown in FIGS. 1A and 1B can have dimensions of about 600 microns×10 microns×50 microns, or 1000 microns×600 microns×25 microns, or any other suitable dimensions.

Contact 108 and staging layer 110 are placed on insulating layer 106, as appropriate. In various embodiments, staging layer 110 supports cantilever 112 above insulating layer 106, creating a gap 116 that can be vacuum or can become filled with air or another gas or liquid such as oil. Although the size of gap 116 varies widely with different implementations, an exemplary gap 116 can be on the order of 1–100 microns, such as about 20 microns, Contact 108 can receive cantilever 112 when relay 100 is in a closed state, as described below. Contact 108 and staging layer 110 can be formed of any conducting material such as gold, gold alloy, silver, copper, aluminum, metal or the like. In various embodiments, contact 108 and staging layer 110 are formed of similar conducting materials, and the relay is considered to be "closed" when cantilever 112 completes a circuit between staging layer 110 and contact 108. In certain embodiments wherein cantilever 112 does not conduct electricity, staging layer 110 can be formulated of non-conducting material such as Probimide material, oxide, or any other material. Additionally, alternate embodiments may not require staging layer 110 if cantilever 112 is otherwise supported above insulating layer 106.

Figure 1C:
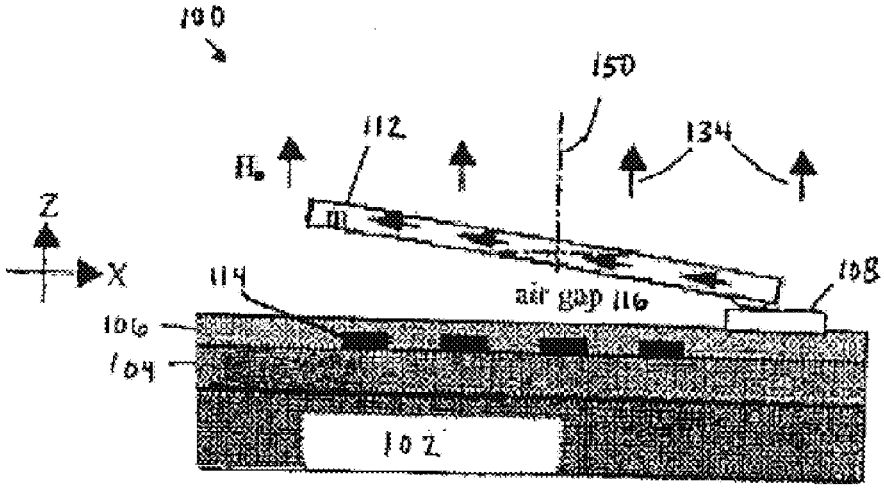
FIGS. 1C and 1D show side and top views, respectively, of an exemplary hinged latching micro-magnetic switch, according to an embodiment of the present invention.
Figure 1D:
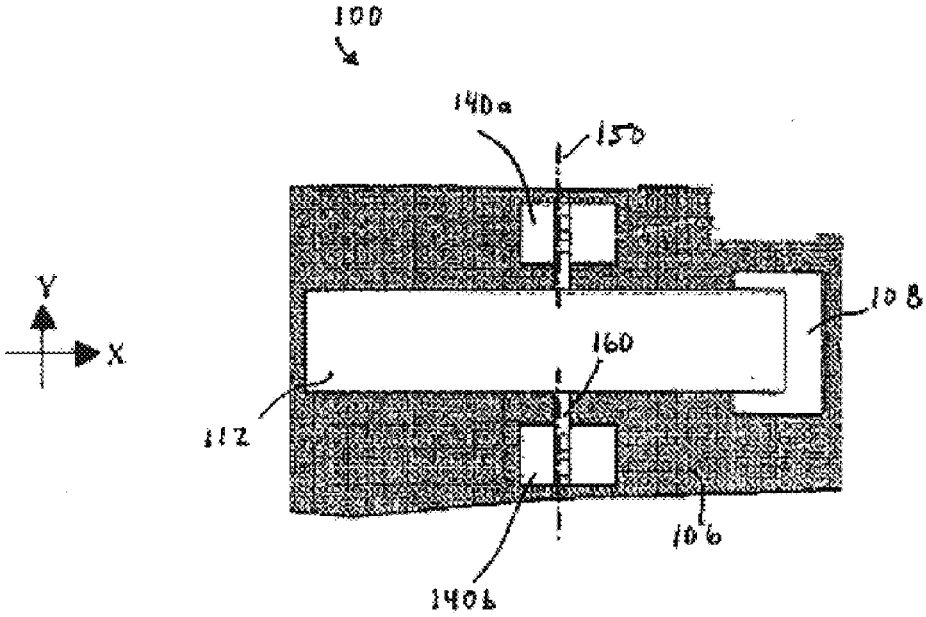

Alternatively, cantilever 112 can be made into a "hinged" arrangement. For example, FIGS. 1C and 1D show side and top views, respectively, of a latching relay 100 incorporating a hinge 160, according to an embodiment of the present invention. Hinge 160 centrally attaches cantilever 112, in contrast to staging layer 110, which attaches an end of cantilever 112. Hinge 160 is supported on first and second hinge supports 140*a* and 140*b*. Latching relay 100 shown in FIGS. 1C and 1D operates substantially similarly to the switch embodiment shown in FIGS. 1A and 1D, except that cantilever 112 flexes or rotates around hinge 160 when changing states. Indicator line 150 shown in FIG. 1C indicates a central axis of cantilever 112 around which cantilever 112 rotates. Hinge 160 and hinge supports 140*a* and 140*b* can be made from electrically or non-electrically conductive materials, similarly to staging layer 110. Relay 100 is considered to be "closed" when cantilever 112 completes a circuit between one or both of first and second hinge supports 140*a* and 104*b*, and contact 108.

Figure 1E:
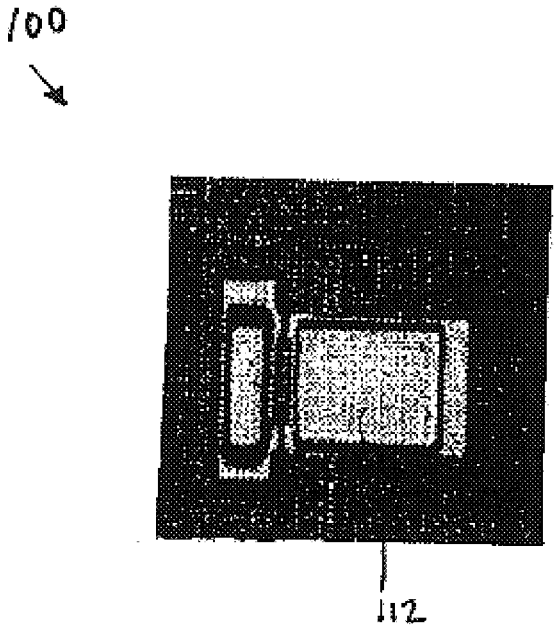
FIG. 1E shows an example implementation of the switch of FIGS. 1A and 1B, according to an embodiment of the present invention.
Figure 1F:
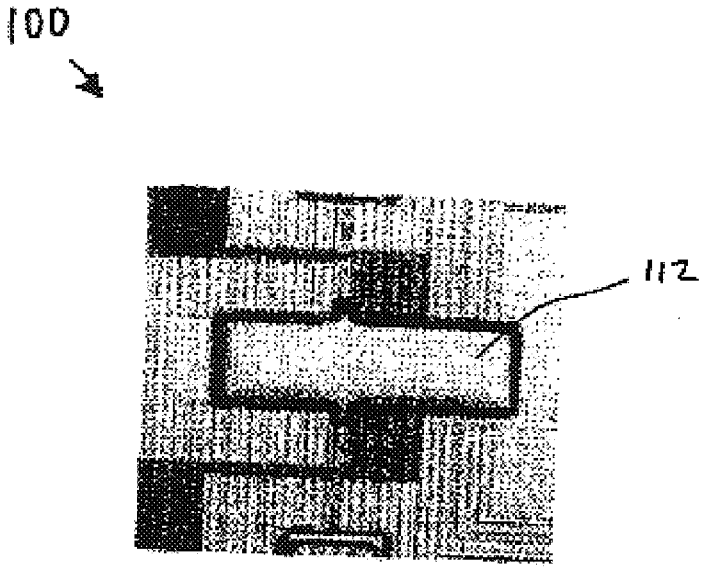
FIG. 1F shows an example implementation of the switch of FIGS. 1C and 1D, according to an embodiment of the present invention.

Relay 100 can be formed in any number of sizes, proportions, and configurations. FIGS. 1E and 1F show examples of relay 100, according to embodiments of the present invention. Note that the examples of relay 100 shown in FIGS. 1E and 1F are provided for purposes of illustration, and are not intended to limit the invention.

FIG. 1E shows an example relay 100 having a fixed end configuration, similar to the embodiment shown in FIGS. 1A and 1B. In the example of FIG. 1E, cantilever 112 has the dimensions of 700 $\mu$m×300 $\mu$m×30 $\mu$m. A thickness of cantilever 112 is 5 $\mu$m. Air gap 116 (not shown in FIG. 1E) has a spacing of 12 $\mu$m under cantilever 112. An associated coil 114 (not shown in FIG. 1E) has 20 turns.

FIG. 1F shows an example relay 100 having a hinge structure, similarly to the embodiment shown in FIGS. 1C and 1D. In the example of FIG. 1F, cantilever 112 has the dimensions of 800 $\mu$m×200 $\mu$m×25 $\mu$m. A pair of torsion flexures (not shown in FIG. 1F) are located in the center of cantilever 112 to provide the hinge function. Each flexure has dimensions of 280 $\mu$m×20 $\mu$m×3 $\mu$m. Air gap 116 (not shown in FIG. 1F) has a spacing of 12 $\mu$m under cantilever 112. An associated coil 114 (not shown in FIG. 1F) has 20 turns.

Principle of Operation of a Micro-Magnetic Latching Switch

When it is in the "down" position, the cantilever makes electrical contact with the bottom conductor, and the switch is "ON" (also called the "closed" state). When the contact end is "up", the switch is "OFF" (also called the "open" state). These two stable states produce the switching function by the moveable cantilever element. The permanent magnet holds the cantilever in either the "up" or the "down" position after switching, making the device a latching relay. A current is passed through the coil (e.g., the coil is energized) only during a brief (temporary) period of time to transition between the two states.

(i) Method to Produce Bi-Stability

Figure 2:
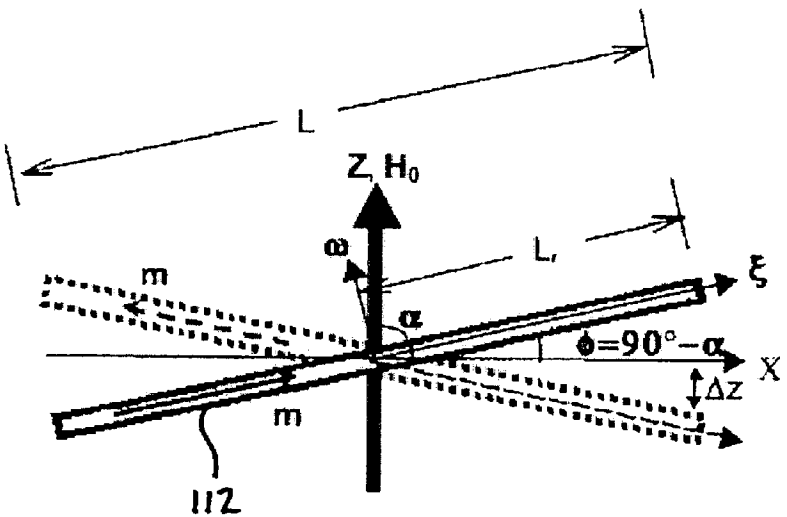
FIG. 2 illustrates the principle by which bi-stability is produced.

The principle by which bi-stability is produced is illustrated with reference to FIG. 2. When the length L of a permalloy cantilever 112 is much larger than its thickness t and width (w, not shown), the direction along its long axis L becomes the preferred direction for magnetization (also called the "easy axis"). When a major central portion of the cantilever is placed in a uniform permanent magnetic field, a torque is exerted on the cantilever. The torque can be either clockwise or counterclockwise, depending on the initial orientation of the cantilever with respect to the magnetic field. When the angle ($\alpha$) between the cantilever axis ($\xi$) and the external field ($H_0$) is smaller than 90°, the torque is counterclockwise; and when $\alpha$ is larger than 90°, the torque is clockwise. The bi-directional torque arises because of the bi-directional magnetization (i.e., a magnetization vector "m" points one direction or the other direction, as shown in FIG. 2) of the cantilever (m points from left to right when $\alpha<90°$, and from right to left when $\alpha>90°$). Due to the torque, the cantilever tends to align with the external magnetic field ($H_0$). However, when a mechanical force (such as the elastic torque of the cantilever, a physical stopper, etc.) preempts to the total realignment with $H_0$, two stable positions ("up" and "down") are available, which forms the basis of latching in the switch.

(ii) Electrical Switching

If the bi-directional magnetization along the easy axis of the cantilever arising from $H_0$ can be momentarily reversed by applying a second magnetic field to overcome the influence of ($H_0$), then it is possible to achieve a switchable latching relay. This scenario is realized by situating a planar coil under or over the cantilever to produce the required temporary switching field. The planar coil geometry was chosen because it is relatively simple to fabricate, though other structures (such as a wrap-around, three dimensional type) are also possible. The magnetic field (Hcoil) lines generated by a short current pulse loop around the coil. It is mainly the $\xi$-component (along the cantilever, see FIG. 2) of this field that is used to reorient the magnetization (magnetization vector "m") in the cantilever. The direction of the coil current determines whether a positive or a negative $\xi$-field component is generated. Plural coils can be used. After switching, the permanent magnetic field holds the cantilever in this state until the next switching event is encountered. Since the $\xi$-component of the coil-generated field (Hcoil-$\xi$) only needs to be momentarily larger than the $\xi$-component [$H_0\xi \sim H_0 \cos(\alpha)=H_0 \sin(\phi)$, $\alpha=90°-\phi$] of the permanent magnetic field and $\phi$ is typically very small (e.g., $\phi \leqq 5°$), switching current and power can be very low, which is an important consideration in micro relay design.

The operation principle can be summarized as follows: A permalloy cantilever in a uniform (in practice, the field can be just approximately uniform) magnetic field can have a clockwise or a counterclockwise torque depending on the angle between its long axis (easy axis, L) and the field. Two bi-stable states are possible when other forces can balance die torque. A coil can generate a momentary magnetic field to switch the orientation of magnetization (vector m) along the cantilever and thus switch the cantilever between the two states.

Relaxed Alignment of Magnets

The second magnetic field may be generated through, for example, a magnet such as an electronically-controlled electromagnet. Alternatively, the second magnetic field may be generated by passing a current through conductor 114. As current passes through conductor 114, a magnetic field is produced in accordance with a "right-hand rule". For example, a current flowing from point 126 to point 128 on conductor 114 (FIG. 1B) typically generates a magnetic field "into" the center of the coil shown, corresponding to field arrows 122 in FIG. 1A. Conversely, a current flowing from point 128 to point 126 in FIG. 1 generates a magnetic field flowing "out" of the center o the coil shown, corresponding to dashed field arrows 124 in FIG. 1A. The magnetic field may loop around the conductor 114 in a maimer shown also in FIG. 1A, imposing a horizontal (X) component of the magnetic field on the cantilever 112.

By varying the direction of the current or current pulse flowing in conductor 114. then, the direction of the second magnetic field can be altered as desire . By altering the direction of the second magnetic field, the magnetization of cantilever 112 may be affected and relay 100 may be suitably switched open or closed. When the second magnetic field is in the direction of field arrows 122, for example, the magnetization of cantilever 112 will point toward end 130. This magnetization creates a clockwise torque about end 130 that places cantilever 112 in a "down" state that suitably closes relay 100. Conversely, when the second magnetic field is in the direction of dashed field arrows 124, the magnetization of cantilever 112 points toward end 132, and a counter-clockwise torque is produced that places cantilever 112 in an "up" state that suitably opens relay 100. Hence, the "up" or "down" state of cantilever 112 (and hence the "open" or "closed" state of relay 100) may be adjusted by controlling the current flowing through conductor 114. Further, since the magnetization of cantilever 112 remains constant without external perturbation, the second magnetic field may be applied in "pulse" or otherwise intermittently as required to switch the relay. When the relay does not require a change of state, power to conductor 114 may be eliminated, thus creating a bi-stable latching relay 100 without power consumption in quiescent states. Such a relay is well suited for applications in space, aeronautics, portable electronics, and the like.

To address the issue of relaxing the magnet alignment requirement, the inventors have developed a technique to create perpendicular magnetic fields in a relatively large region around the cantilever. The invention is based on the fact that the magnetic field lines in a low permeability media (e.g., air) are basically perpendicular to the surface of a very high permeability material (e.g., materials that are easily magnetized, such as permalloy). When the cantilever is placed in proximity to such a surface and the cantilever's horizontal plane is parallel to the surface of the high permeability material, the above stated objectives can be at least partially achieved. The generic scheme is described below, followed by illustrative embodiments of the invention.

The boundary conditions for the magnetic flux density (B) and magnetic field (H) follow the following relationships:

| | | |
|---|---|---|
| or | $B_2 \cdot n = B_1 \cdot n,$ | $B_2 \times n = (\mu_2/\mu_1)\, B_1 \times n$ |
| | $H_2 \cdot n = (\mu_2/\mu_1)\, H_1 \cdot n,$ | $H_2 \times n = H_1 \times n$ |

Figure 3:
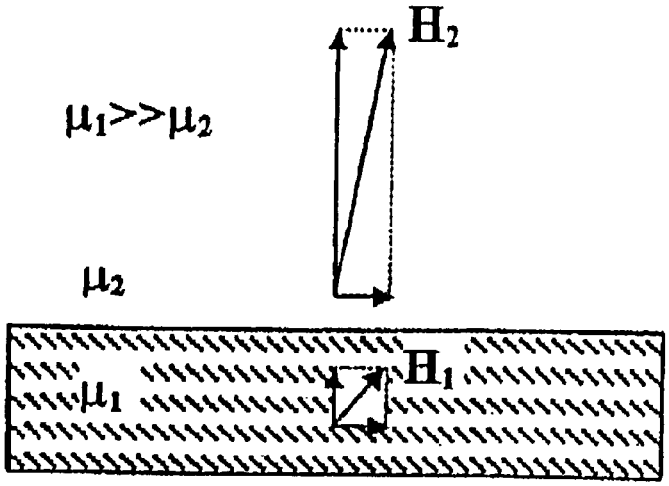
FIG. 3 illustrates the boundary conditions on the magnetic field (H) at a boundary between two materials with different permeability (1>>2).

If $\mu 1 >> \mu 2$, the normal component of H2 is much larger than the normal component of H1, as shown in FIG. 3. In the limit $(\mu 1/\mu 2)$□□, the magnetic field H2 is normal to the boundary surface, independent of the direction of H1 (barring the exceptional case of H1 exactly parallel to the interface). If the second media is air ($\mu 2=1$), then $B2=\mu 0$ H2, so that the flux lines B2 will also be perpendicular to the surface. This property is used to produce magnetic fields that are perpendicular to the horizontal plane of the cantilever in a micro-magnetic latching switch and to relax the permanent magnet alignment requirements.

This property, where the magnetic field is normal to the boundary surface of a high-permeability material, and the placement of the cantilever (i.e., soft magnetic) with its horizontal plane parallel to the surface of the high-permeability material, can be used in many different configurations to relax the permanent magnet alignment requirement.

Connecting Circuits Using Micro-Magnetic Latching Switches of the Present Invention Operation of the micro-magnetic latching switches of the present invention, described above, can be used to implement various electrical and optical components. For example, components can be formed by using the latching switches of the present invention to couple circuits into and out of signal paths and/or other circuits as needed. Any type of circuit may be coupled into a signal path/other circuit, including discrete components, such as resistors, capacitors, inductors, diodes, transistors, and other discrete components, active components, such as amplifiers, any combination of components, such as attenuator and filter circuits, and any other circuit type. Example embodiments are provided below that use latching switches to couple circuits into signal paths, as are example circuits that can be coupled into the signal paths. These embodiments are provided for illustrative purposes only, and are not limiting. Alternative embodiments will be apparent to persons skilled in the relevant art(s) based on the discussion contained herein. As will be appreciated by persons skilled in the relevant art(s), other circuits and latching switch configurations are within the scope and spirit of the present invention.

The micro-magnetic latching switches of the present invention are particularly useful for these applications. They have advantages of being small, having very low insertion loss, and having very good linearity. Available conventional switch technology that would be used for such an application has limitations. For example, PIN diodes have high insertion loss and consume considerable power. GaAs FETs have mediocre RF performance, and conventional relays are large, expensive, and have limited contact life.

FIGS. 4A–4E illustrate block diagrams showing various example circuit-coupling blocks that use latching switches of the present invention to couple a circuit into a signal path. FIGS. 4A–4E focus on showing different types of cantilever 112, and do not show all elements of relay 100, which are described in further detail elsewhere herein. In each of FIGS. 4A–4E, one or more latching relays 100 couple a circuit 410 in and out of a signal path between a first signal line 402 and a second signal line 404. First and second signal lines 402 and 404 may also be considered to be signal lines that interface with another circuit. By switching a latching micro-magnetic switch between first and second states, circuit 410is either bypassed, or is coupled between first signal line 402 and second signal line 404.

Figure 4A:
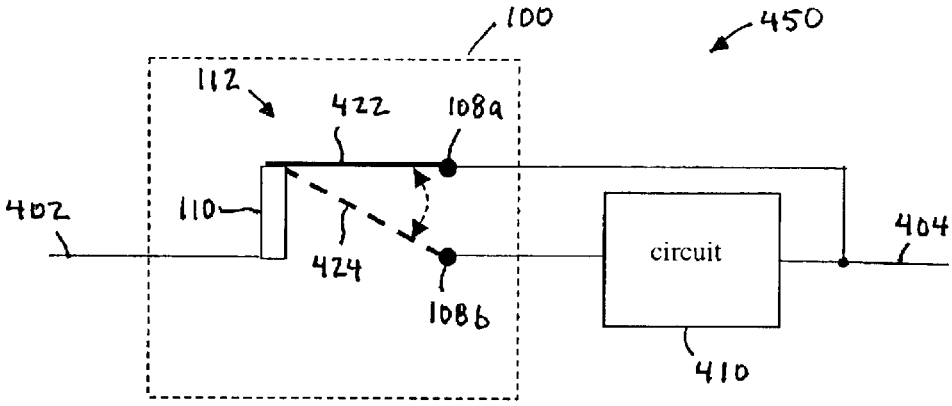
FIGS. 4A–4E illustrate block diagrams showing various example embodiments that use latching switches of the present invention to couple a circuit into another circuit or signal path.

FIG. 4A shows a circuit-coupling block 450 that includes a fixed-end relay 100. Circuit-coupling block 450 is suitable for DC and low-frequency signal applications, although may be appropriate in some RF applications. In a first state for relay 100, cantilever 112 is in a first position 422, and the moveable end of cantilever 112 is in contact with a first contact 108*a*. In first position 422, first signal line 402 is coupled directly to second signal line 404 by a conductive path that includes staging layer 110 and cantilever 112. Thus, in the first state, circuit 410 has no effect on a signal transmitting between first signal line 402 and second signal line 404.

In a second state for relay 100 of block 450, cantilever 112 is in a second position 424, and the moveable end of cantilever 112 is in contact with a second contact 108*b*. In second position 424, circuit 410 is coupled into the signal path between first signal line 402 and second signal line 404, and thus can have an effect on a signal transmitting between first signal line 402 and second signal line 404.

Note that the configuration shown in FIG. 4A can be modified to use a hinged cantilever 112. Furthermore, note that in an alternative embodiment, contacts 108*a* and 108*b* can be reversed, so that circuit 410 is coupled between first signal line 402 and second signal line 404 when cantilever 112 is in first position 422. It will be apparent to persons skilled in the relevant art(s) that such alternative configurations are applicable to all of the embodiments described herein.

Figure 4B:
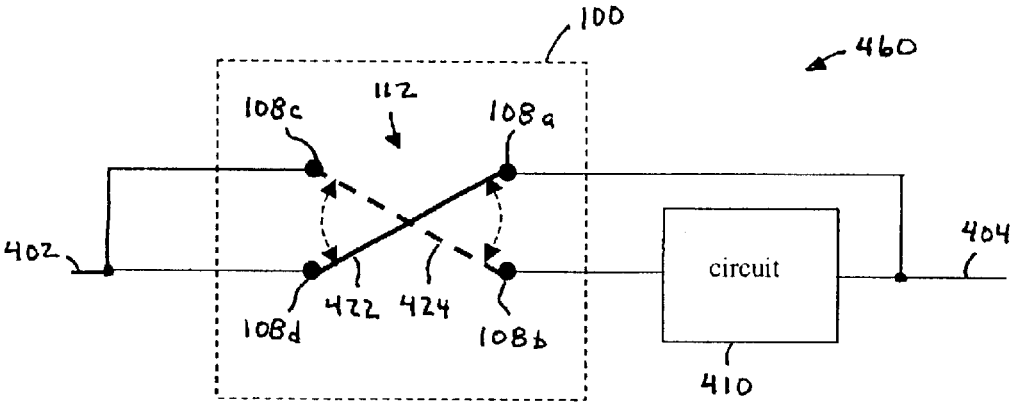

FIG. 4B shows a circuit-coupling block 460 having a relay 100 with hinged cantilever 112. Circuit-coupling block 460 is suitable for DC and low-frequency signal applications, although may be appropriate in some RF applications. In block 460, cantilever 112 can conduct an electrical signal along its length. In a first state for relay 100, cantilever 112 is in a first position 422, and cantilever 112 couples first contact 108*a* to a fourth contact 108*d*. Thus, in first position 422, first signal line 402 is coupled by a conductive path through cantilever 112 directly to second signal line 404. Hence, in the first state, circuit 410 has no effect on a signal transmitting between first signal line 402 and second signal line 404.

In a second state for relay 100 of block 460, cantilever 112 is in a second position 424, coupling second contact 108*b* to a third contact 108*c*. Thus, in second position 424, circuit 410 is coupled into the signal path between first signal line 402 and second signal line 404, and therefore can have an effect on a signal transmitting between first signal line 402 and second signal line 404.

Figure 4C:
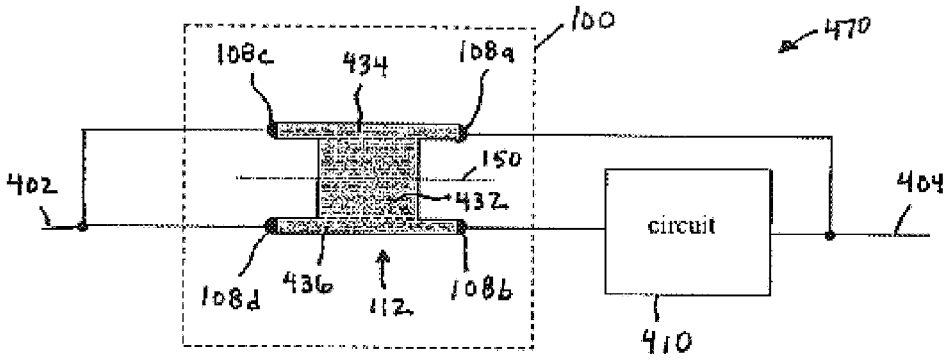

FIG. 4C shows a circuit-coupling block 470 having a relay 100 with hinged cantilever 112. Circuit-coupling block 470 is suitable for DC and low-frequency signal applications, although may be appropriate in some RF applications. Cantilever 112 has two electrically conductive portions: first electrically conductive portion 434 and second electrically conductive portion 436. An body 432 of cantilever 112 electrically separates first and second electrically conductive portions 434 and 436. Cantilever 112 hinges around indicator line 150, such that as first electrically conductive portion 434 moves upward (i.e., out of the page), second electrically conductive portion 436 moves downward (i.e., into the page), and vice versa. In a first state for relay 100, cantilever 112 couples first contact 108*a* to third contact 108*c* with first electrically conductive portion 434. Thus, in this first state, first signal line 402 is coupled through a conductive path of first electrically conductive portion 434 directly to second signal line 404. Hence, in the first state, circuit 410 has no effect on a signal transmitting between first signal line 402 and second signal line 404.

In a second state for relay 100 of block 470, cantilever 112 couples second contact 108*b* to a fourth contact 108*d* with second electrically conductive portion 436. Thus, in this second state, circuit 410 is coupled into the signal path between first signal line 402 and second signal line 404. Therefore, circuit 410 can have an effect on a signal transmitting between first signal line 402 and second signal line 404.

Figure 4D:
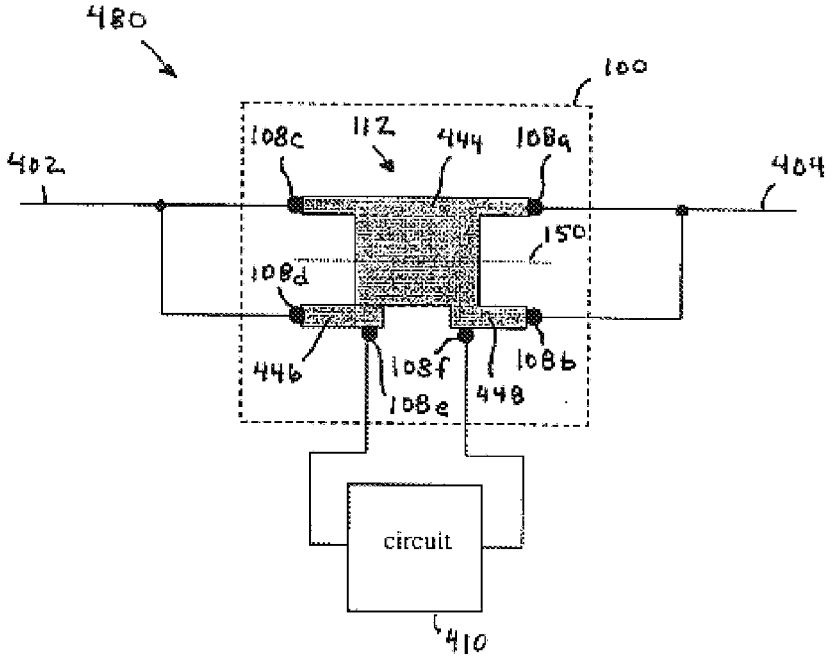

FIG. 4D shows a circuit-coupling block 480 having a relay 100 with hinged cantilever 112. Circuit-coupling block 480 is suitable for DC, low-frequency, and high frequency signal applications, including RF applications. Cantilever 112 has three electrically conductive portions: first electrically conductive portion 444, second electrically conductive portion 446, and third electrically conductive portion 448. Body 432 of cantilever 112 electrically separates first, second, and third electrically conductive portions 444, 446, and 448. Cantilever 112 hinges around indicator line 150, such that as first electrically conductive portion 444 moves upward (i.e., out of the page), second and third electrically conductive portions 446 and 448 move downward (i.e., into the page), and vice versa. In block 480, circuit 410 is coupled between fifth and sixth contacts 108*e* and 108*f*. In a first state for relay 100, cantilever 112 couples first contact 108*a* to third contact 108*c* with a conductive path of first electrically conductive portion 444. Thus, in this first state, first signal line 402 is coupled through first electrically conductive portion 444 directly to second signal line 404. Therefore, in the first state, circuit 410 has no effect on a signal transmitting between first signal line 402 and second signal line 404.

In a second state for relay 100 of block 480, cantilever 112 couples fourth contact 108*d* to fifth contact 108*e* through second electrically conductive portion 446, and couples second contact 108*b* to sixth contact 108*e* through third electrically conductive portion 448. Thus, in this second state, circuit 410 is coupled into the signal path between first signal line 402 and second signal line 404 by a conductive path that includes second and third electrically conductive portions 446 and 448. Therefore, in the second state, circuit 410can have an effect on a signal transmitting between first signal line 402 and second signal line 404.

Figure 4E:
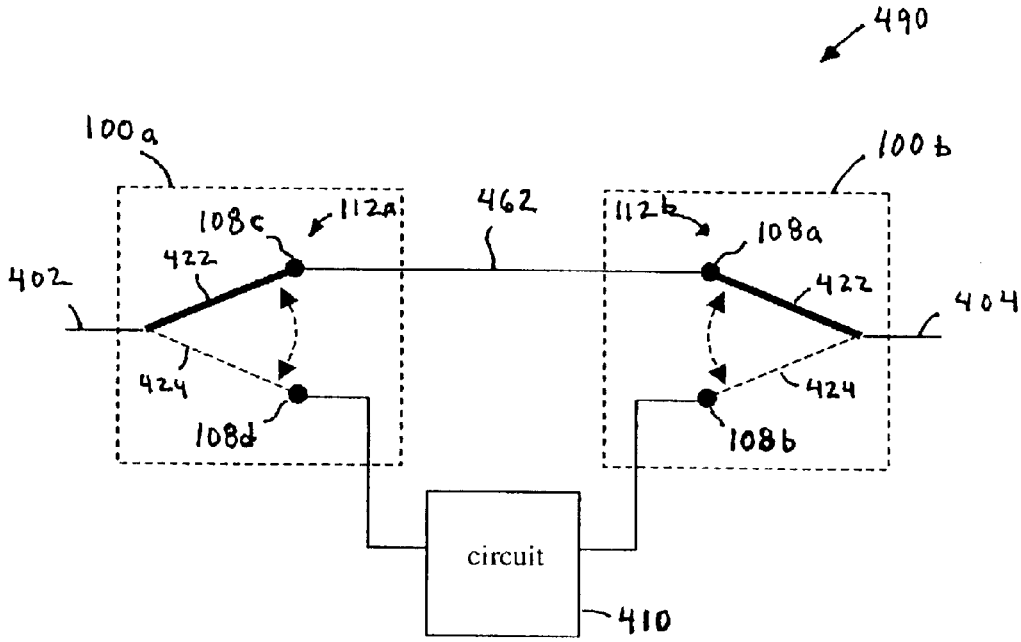

FIG. 4E shows a circuit-coupling block 490 having first and second relays 100*a* and 100*b*, each with a corresponding cantilever 112*a* and 112*b*, respectively. Cantilevers 112*a* and 112*b* can be either fixed-end or hinged types. Circuit-coupling block 490 is suitable for DC, low-frequency, and high frequency signal applications, and is particularly suitable for RF applications.

In block 490, circuit 410 is coupled between second and fourth contacts 108*b* and 108*d*. In a first state for relays 100*a* and 100*b*, cantilever 112*a* couples first signal line 402 to third contact 108*c*, and cantilever 112*b* couples first contact 108*a* to second signal line 404. A third signal line 462 forms a conductive path between third contact 108*c* and first contact 108*a*. Third signal line 462 is a wire, cable, trace, transmission line, or any other electrically conductive signal path. Thus, in this first state, first signal line 402 is coupled through third signal line 462 directly to second signal line 404. Therefore, in the first state, circuit 410 has no effect on a signal transmitting between first signal line 402 and second signal line 404.

In a second state for relays 100*a* and 100*b* of block 490, cantilevers 112*a* couples first signal line 402 to fourth contact 108*d*, and cantilever 112*b* couples second contact 108*b* to second signal line 404. Thus, in this second state, circuit 410 is coupled into the signal path between first signal line 402 and second signal line 404. Therefore, in the second state, circuit 410 can have an effect on a signal transmitting between first signal line 402 and second signal line 404. Note that in either state for block 490, there are no signal line stubs hanging from a conducting portion of the signal path between first and second signal lines 402 and 404 that can adversely affect RF performance.

Figure 5B:
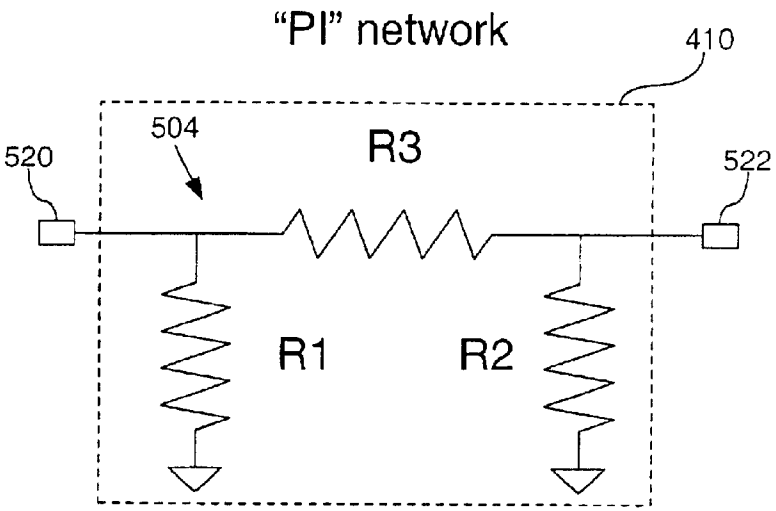
FIGS. 5A and 5B illustrate resistor-based attenuator circuits, according to example embodiments of the present invention.
Figure 5A:
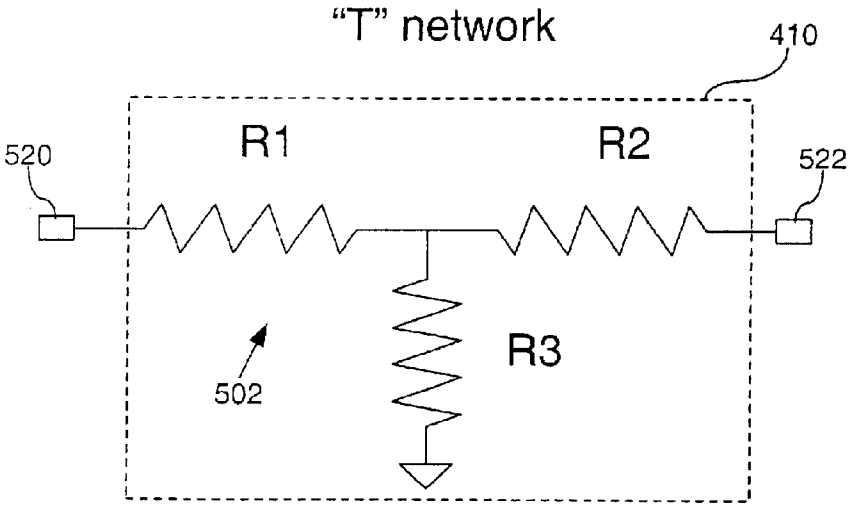
Figure 5D:
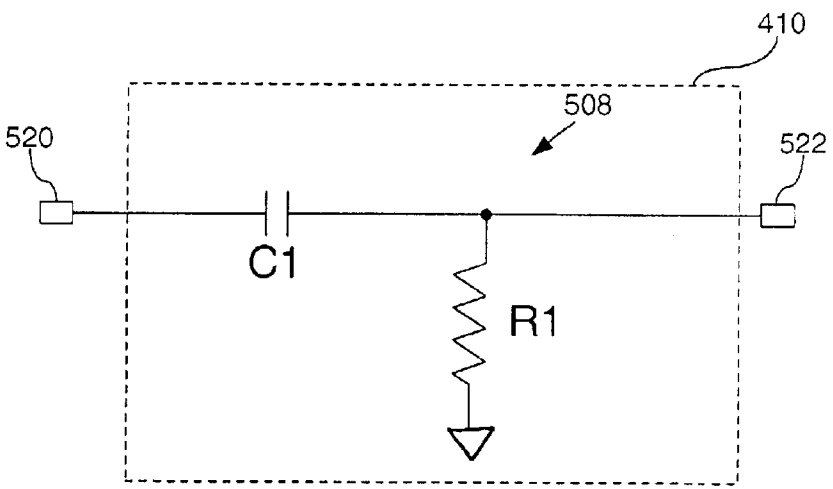
FIGS. 5C and 5D illustrate filter circuits, according to example embodiments of the present invention.
Figure 5C:
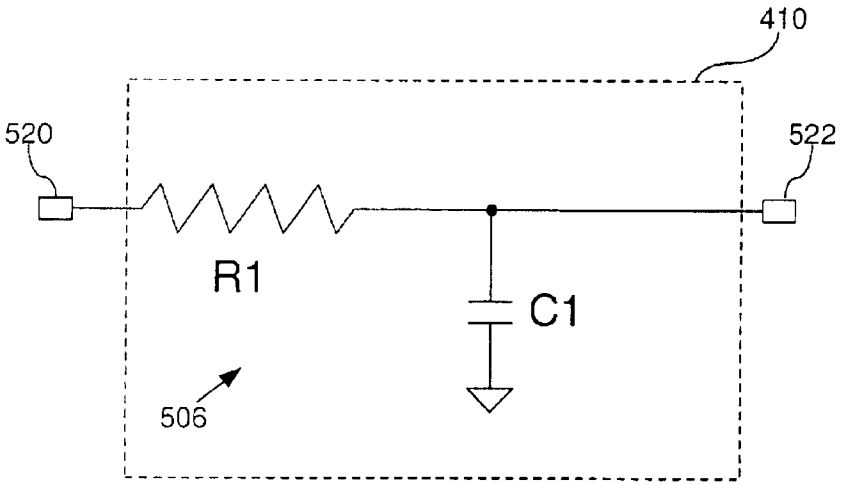

Circuit 410 of FIGS. 4A–4E can include a variety of circuit components, and component configurations. For example, circuit 410 can include discrete components, such as resistors, capacitors, inductors, diodes, transistors, and other discrete components, and active components, such as amplifiers. Circuit 410 can include any combination of components, such as an attenuator configuration, a capacitor/capacitive network, a filter, or the like. FIGS. 5A–5D illustrate embodiments for circuit 410, according to the present invention, which are provided for illustrative purposes, and are not intended to limit the invention. As shown in FIGS. 5A–5D, each example circuit 410 has an input signal or node 520 and an output signal or node 522. FIG. 5A shows a first example resistor-based attenuator configuration 502, which is sometimes referred to as a "T" network. FIG. 5B shows a second example resistor-based attenuator configuration 504, which is sometimes referred to as a "Pi" ($\pi$) network. FIG. 5C shows a low-pass filter configuration 506. FIG. 5D shows a high-pass filter configuration 508. Circuit 410 can include any of the configurations described herein, other circuit configurations, or any combination thereof.

Figure 6A:
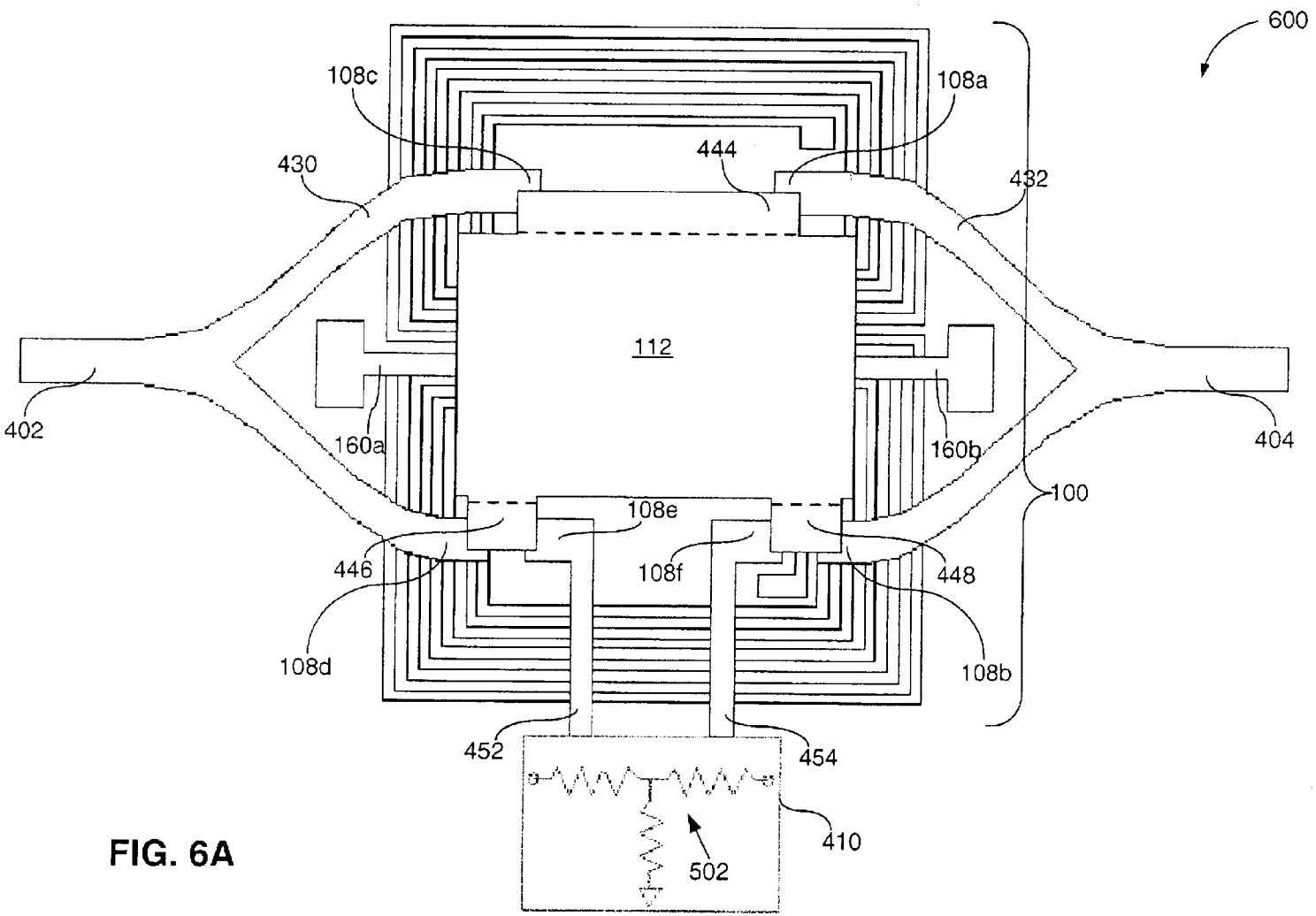
FIG. 6A illustrates a top view of a latching micro-magnetic switch, according to an example embodiment of the present invention.
Figure 6B:
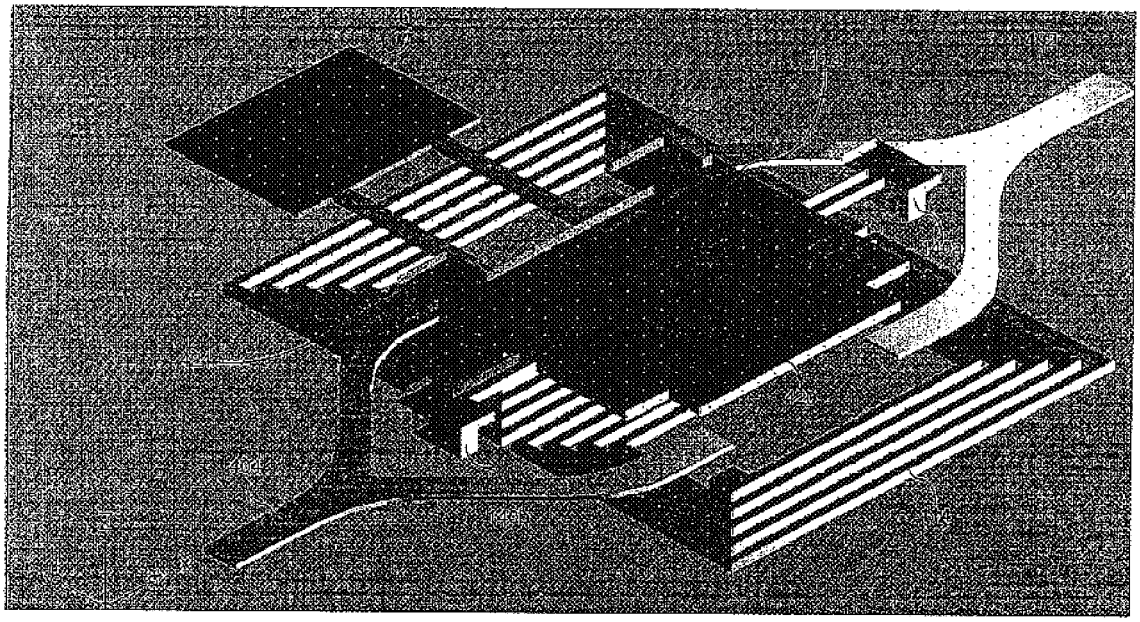
FIG. 6B illustrates a three-dimensional perspective view of the latching micro-magnetic switch of FIG. 6A, according to an example embodiment of the present invention.

A detailed circuit-coupling block 600 is shown in FIGS. 6A and 6B, according to an example embodiment of the present invention. FIG. 6A illustrates a detailed top view, and FIG. 6B illustrates a perspective view, of a relay 100 that couples circuit 410into a signal path. For illustrative purposes, circuit 410 is shown in FIG. 6A as resistor-based attenuator configuration 502. As shown in FIG. 6A, a first signal line 402 is electrically coupled to a second signal line 404 by cantilever 112 of relay 100. Relay 100 is of the hinged-type, and includes hinges 160*a* and 160*b* that are attached to cantilever 112, and about which cantilever 112 rotates. Cantilever 112 comprises three electrical contact regions: first, second, and third electrically conductive portions 444, 446, and 448. In a first state, first electrically conductive portion 444 of cantilever 112 electrically connects portions 430 and 432 of signal lines 402 and 404, respectively. In a second state, second and third electrically conductive portions 446 and 448 electrically connect signal lines 402 and 404 through circuit 410. A first circuit lead (e.g., signal line, lead, or conductive trace) 452 is coupled by second electrically conductive portion 446 to first signal line 402. A second circuit lead (e.g., signal line, lead, or conductive trace) 454 is coupled by third electrically conductive portion 448 to second signal line 404. Exemplary hinge supports 140*a* and 140*b* are also shown in FIG. 6B.

Embodiments of the present invention for coupling a circuit to a signal path can be used individually, or may be cascaded together in series, in combinations of any number of two or more. For example, cascaded embodiments of the present invention may be used to create devices, such as a phased array antenna device or other device type. Such a device includes a plurality of circuit-coupling blocks that each control the coupling of a circuit into a signal path. Example programmable attenuator devices are described below to illustrate an how embodiments of the present invention may be coupled in series. The present invention is not limited to these example embodiments. It would understood to persons skilled in the relevant art(s) how to implement alternative series-coupled devices, according to the present invention, from the teachings herein.

Figure 7A:
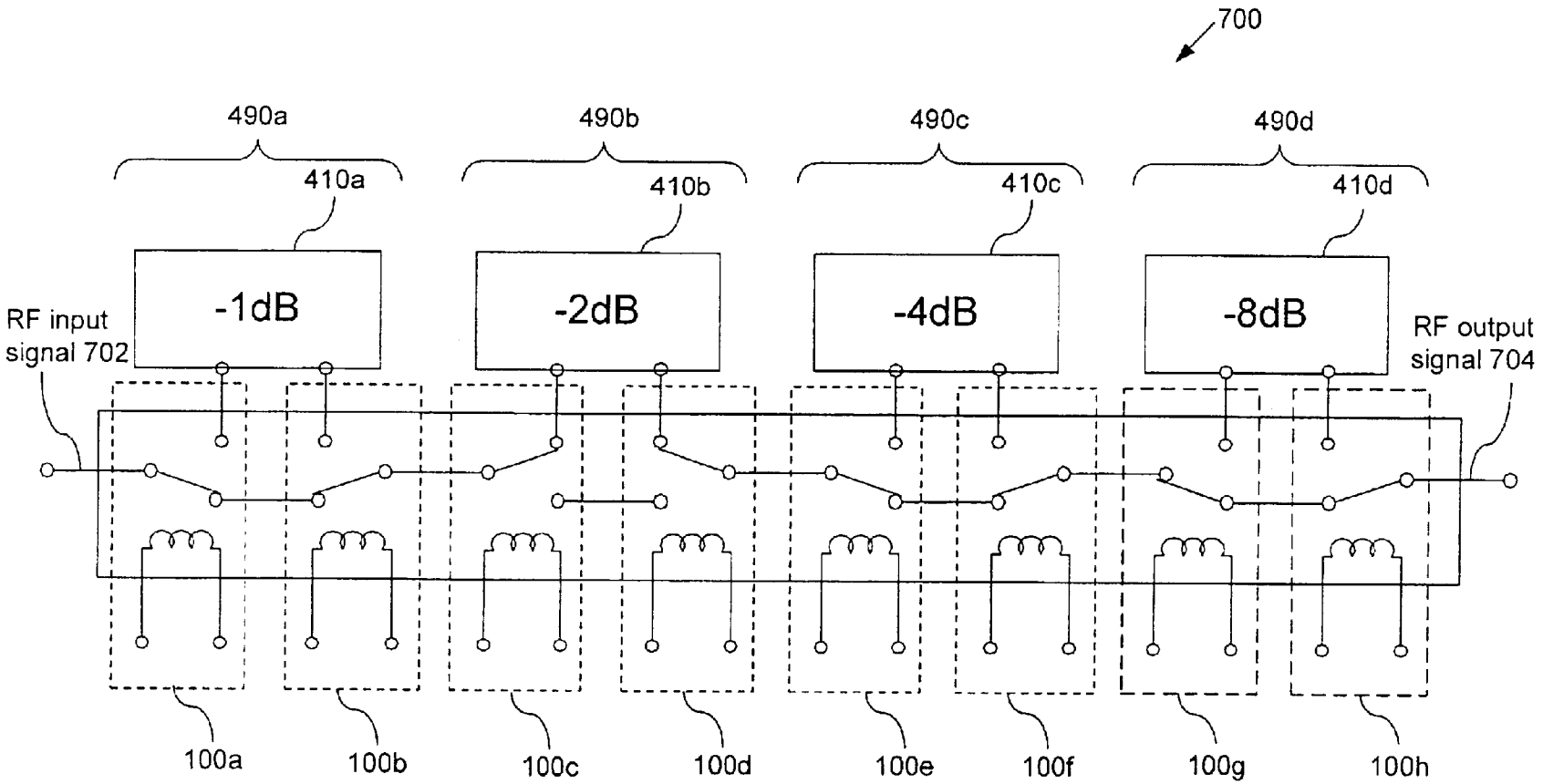
FIGS. 7A and 7B illustrate a 4-bit programmable attenuator using four latching micro-magnetic switches, according to example embodiments of the present invention.
Figure 7B:
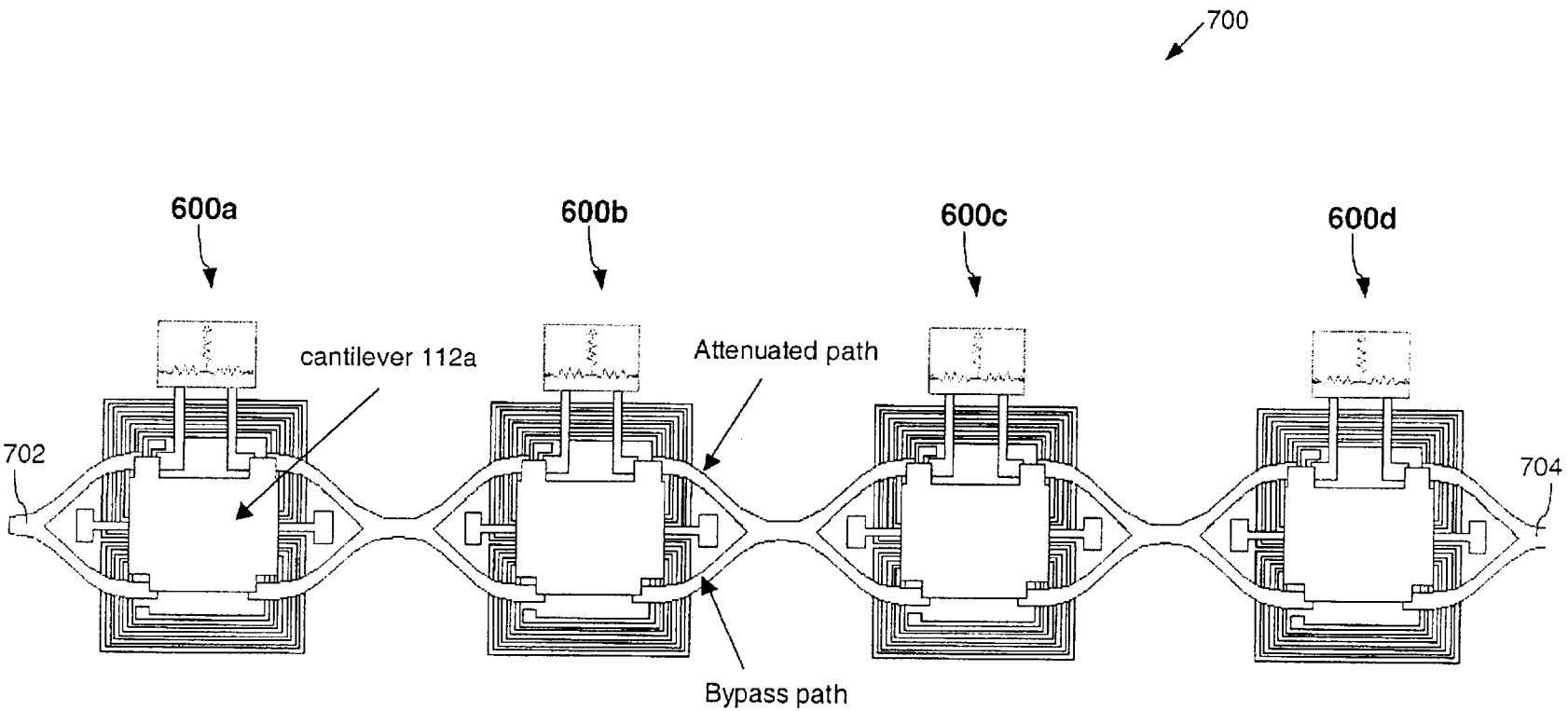

FIGS. 7A and 7B illustrate example series-coupled, programmable devices, according to embodiments of the present invention. FIG. 7A illustrates a block diagram of a 4-bit programmable attenuator 700 using four series-coupled circuit-coupling blocks 490*a–d*, as shown in FIG. 4E. FIG. 7B shows a detailed example schematic diagram of an alternative attenuator 700 using four series-coupled circuit-coupling blocks 600*a–d*, as shown in FIG. 6A. Each of blocks 490*a–d* and blocks 600*a–d* are paired with a corresponding circuit 410*a–d*.

As shown in FIGS. 7A and 7B, an RF input signal 702 is applied to an input of programmable attenuator 700, and an RF output signal 704 is produced at an output of attenuator 700. Each of circuit-coupling blocks 490*a–d* and 600*a–d* are used as attenuator blocks to switch in or out of the signal path a corresponding amount of attenuation. Switching of associated coils is described in further detail above. Circuits 410*a–d* provide 1, 2, 4, and 8 decibels (dBs) of attenuation, respectively. In this manner, up to 15 dBs of attenuation can be added in increments of one dB.

Other configurations and weightings of attenuator blocks can be implemented without departing from the spirit and scope of the present invention. Furthermore, alternatively, capacitive blocks can be used in a similar arrangement, rather that attenuator blocks, to form a programmable capacitive network device. Furthermore, filter blocks can be instead used, to create a programmable filter device. Still further, delay blocks can be used to create a programmable delay device. For example, circuits 410*a–n* can each include a delay element, such as a delay circuit or length of transmission line. The length of transmission line can be of a different length than the short circuit signal path, to create a variation in delay. Moreover, other circuit-coupling blocks or elements, such as phase array antenna elements, can be substituted in place of attenuator blocks 710*a–d*, to create a programmable antenna device, without departing from the spirit and scope of the present invention. Thus, the present invention can be used to create variable attenuators, steerable antennas (phased array antennas), automotive collision avoidance systems, variable phase delay circuits, variable inductors, variable capacitors, variable filters, and the like. The use of the latching micro-magnetic switches of the present invention for switching in and out various phase array antenna elements, and/or other circuits, will be apparent to a person skilled in the relevant art based on the description herein.

In an embodiment, a circuit-coupling block of the present invention, such as those shown in FIGS. 4A–4E, could be manufactured as a single integrated circuit chip, with all components on-chip except for circuit 410. Such a chip has user-available I/O pins for coupling circuit 410 to the chip, to make a complete system. Thus, general purpose circuit-coupling blocks could be placed in chips for use or sale, where a user could determine which type of circuit to couple to the chip, depending on the particular application. Furthermore, in embodiments, a chip could have a plurality of series-coupled blocks, with multiple user-available I/O pins for coupling multiple circuits 410 into a signal path.

Example Embodiments for Performing the Present Invention

Figure 8:
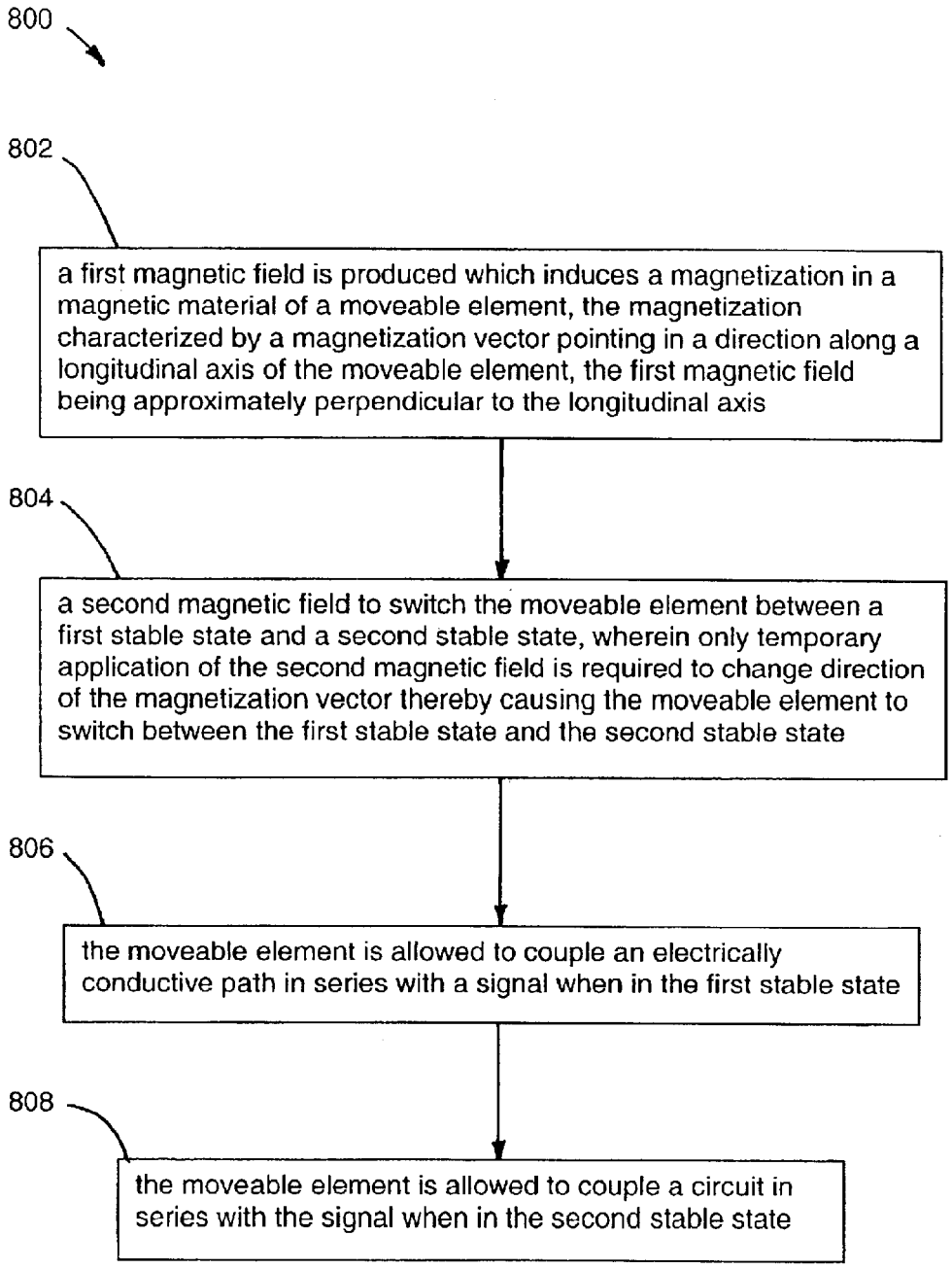
FIG. 8 shows a flowchart providing steps for controlling the coupling of a circuit into another circuit or signal path, according to an example embodiment of the present invention.

FIG. 8 shows a flowchart 800 providing steps for controlling the coupling of a circuit into a signal path, according to an example embodiment of the present invention. The steps of FIG. 8 do not necessarily have to occur in the order shown, as will be apparent to persons skilled in the relevant art(s) based on the teachings herein. Other structural and operational embodiments will be apparent to persons skilled in the relevant art(s) based on the following discussion. These steps are described in detail below.

Flowchart 800 begins with step 802. In step 802, a first magnetic field is produced which induces a magnetization in a magnetic material of a moveable element, the magnetization characterized by a magnetization vector pointing in a direction along a longitudinal axis of the moveable element, the first magnetic field being approximately perpendicular to the longitudinal axis. For example, the first magnetic field is HO 134, as shown in FIGS. 1A and 1C. The magnetic field can be produced by magnet 102, which can be a permanent magnet. In an alternative embodiment, the magnetic field is produced by more than one permanent magnet, such as a first permanent magnet above and a second permanent magnet below cantilever 112. A magnetization induced in the magnetic material can be characterized as a magnetization vector, such as magnetization vector "m" as shown in FIG. 2. As shown in FIGS. 1A and 1C, first magnetic field HO 134 is approximately perpendicular to a long axis L for cantilever 112 (e.g., as shown in FIG. 2).

In step 804, a second magnetic field is produced to switch the moveable element between a first stable state and a second stable state, wherein only temporary application of the second magnetic field is required to change direction of the magnetization vector thereby causing the moveable element to switch between the first stable state and the second stable state. For example, the second magnetic field is produced by coil 114 shown in FIGS. 1A–1D. The second magnetic field switches cantilever 112 between two stable states, such as the first and second stable states described above. As described above, only a temporary application of the second magnetic field produced by coil 114 is required to change direction of magnetization vector "m" shown in FIG. 2. Changing the direction of magnetization vector "m" causes cantilever 112 to switch between the first stable state and the second stable state.

In step 806, the moveable element is allowed to couple a electrically conductive path in series with a signal when in the first stable state. For example, FIGS. 4A–4C illustrate how short circuits/conductive paths are coupled between first signal line 402 and second signal line 404 by cantilever 112 when in a first stable state.

In step 808, the moveable element is allowed to couple a circuit in series with the signal when in the second stable state. For example, FIGS. 4A–4C each illustrate how circuit 410can be coupled between first signal line 402 and second signal line 404 by cantilever 112 when in a second stable state. Numerous embodiments for circuit 410 are described above, with some examples shown in FIGS. 5A–5D.

Conclusion

The corresponding structures, materials, acts and equivalents of all elements in the claims below are intended to include any structure, material or acts for performing the functions in combination with other claimed elements as specifically claimed. Moreover, the steps recited in any method claims may be executed in any order. The scope of the invention should be determined by the appended claims and their legal equivalents, rather than by the examples given above. Finally, it should be emphasized that none of the elements or components described above are essential or critical to the practice of the invention, except as specifically noted herein.

What is claimed is:

1. A device, comprising:

a plurality of circuit-coupling blocks that are serially coupled along a path of a signal, each circuit-coupling block comprising:

a moveable element supported by a substrate and having a magnetic material and a long axis, at least one magnet that produces a first magnetic field, which induces a magnetization in said magnetic material, said magnetization characterized by a magnetization vector pointing in a direction along said long axis of said moveable element, wherein said first magnetic field is approximately perpendicular to a major central portion of said long axis, and a coil that produces a second magnetic field to switch said moveable element between first and second stable states, wherein only temporary application of said second magnetic field is required to change direction of said magnetization vector thereby causing said moveable element to switch between said first and second stable states;

wherein in said first stable state, said moveable element couples an electrical conductor in series with the signal; and wherein in said second stable state, said moveable element couples a corresponding circuit in series with the signal, wherein each said moveable element comprises first, second, and third electrically conductive portions.

2. The apparatus of claim 1, wherein for each circuit-coupling block:

when in said first stable state, said first electrically conductive portion is coupled in series with the signal as said electrical conductor; and when in said second stable state, said second electrically conductive portion couples a corresponding first signal line of the signal to an input to said corresponding circuit, and said third electrically conductive portion couples a corresponding second signal line of the signal to an output of said corresponding circuit.

3. An apparatus for controlling the coupling of a circuit into a signal path, comprising:

a moveable element supported by a substrate and having a magnetic material and a long axis;

at least one magnet that produces a first magnetic field, which induces a magnetization in said magnetic material, said magnetization characterized by a magnetization vector pointing in a direction along said long axis of said moveable element, wherein said first magnetic field is approximately perpendicular to a major central portion of said long axis; and a coil that produces a second magnetic field to switch said moveable element between first and second stable states, wherein only temporary application of said second magnetic field is required to change direction of said magnetization vector thereby causing said moveable element to switch between said first and second stable state;

wherein in said first stable state, said moveable element does not couple the circuit in series with a signal; and wherein in said second stable state, said moveable element couples the circuit in series with the signal, wherein said circuit is an attenuator circuit.

4. The apparatus of claim 3, wherein said attenuator circuit is a resistive attenuator circuit.

5. An apparatus for controlling the coupling of a circuit into a signal path, comprising:

a moveable element supported by a substrate and having a magnetic material and a long axis;

at least one magnet that produces a first magnetic field, which induces a magnetization in said magnetic material, said magnetization characterized by a magnetization vector pointing in a direction along said long axis of said moveable element, wherein said first magnetic field is approximately perpendicular to a major central portion of said long axis; and a coil that produces a second magnetic field to switch said moveable element between first and second stable states, wherein only temporary application of said second magnetic field is required to change direction of said magnetization vector thereby causing said moveable element to switch between said first and second stable states;

wherein in said first stable state, said moveable element does not couple the circuit in series with a signal; and wherein in said second stable state, said moveable element couples the circuit in series with the signal, wherein said circuit is a capacitive circuit.

6. An apparatus for controlling the coupling of a circuit into a signal path, comprising:

a moveable element supported by a substrate and having a magnetic material and a long axis;

at least one magnet that produces a first magnetic field, which induces a magnetization in said magnetic material, said magnetization characterize by a magnetization vector pointing in a direction along said long axis of said moveable element, wherein said first magnetic field is approximately perpendicular to a major central portion of said long axis; and a coil that produces a second magnetic field to switch said moveable element between first and second stable states, wherein only temporary application of said second magnetic field is required to change direction of said magnetization vector thereby causing said moveable element to switch between said first and second stable states;

wherein in said first stable state, said moveable element does not couple the circuit in series with a signal; and wherein in said second stable state, said moveable element couples the circuit in series with the signal, wherein said circuit is a filter circuit.

7. An apparatus for controlling the coupling of a circuit into a signal path, comprising:

a moveable element supported by a substrate and having magnetic material and a long axis;

at least one magnet that produces a first magnetic field, which induces a magnetization in said magnetic material, said magnetization characterized by a magnetization vector pointing in a direction along said long axis of said moveable element, wherein said first magnetic field is approximately perpendicular to a major central portion of said long axis; and a coil that produces a second magnetic field to switch said moveable element between first and second stable states, wherein only temporary application of said second magnetic field is required to change direction of said magnetization vector thereby causing said moveable element to switch between said first and second stable state;

wherein in said first stable state, said moveable element does not couple the circuit in series with a signal; and wherein in said second stable state, said moveable element couples the circuit in series with the signal, wherein said moveable element comprises first and second electrically conductive portions.

8. The apparatus of claim 7, wherein in said first stable state, said first electrically conductive portion is coupled in series with the signal; and wherein in said second stable state, said second electrically conductive portion couples a first signal line of the signal to said circuit.

9. An apparatus for controlling the coupling of a circuit into a sign path, comprising:

a moveable element supported by a substrate and having a magnetic material and a long axis;

at least one magnet that produces a first magnetic field, which induces a magnetization in said magnetic material, said magnetization characterized by a magnetization vector pointing in a direction along said long axis of said moveable element, wherein said first magnetic field is approximately perpendicular to a major central portion of said long axis; and a coil that produces a second magnetic field to switch said moveable element between first and second stable states, wherein only temporary application of said second magnetic field is required to change direction of said magnetization vector thereby causing said moveable element to switch between said first and second stable states;

wherein in said first stable state, said moveable element does not couple the circuit in series with a signal; and wherein in said second stable state, said moveable element couples the circuit in series with the signal, wherein said moveable element comprises first, second, and third electrically conductive portions.

10. The apparatus of claim 9, wherein in said first stable state, said first electrically conductive portion is coupled in series with the signal; and wherein in said second stable state, said second electrically conductive portion couples a first signal line of the signal to an input to said circuit, and said third electrically conductive portion couples a second signal line of the signal to an output of said circuit.

11. A device, comprising:

a plurality of circuit-coupling blocks that are serially coupled along a path of a signal, each circuit-coupling block comprising:

a moveable element supported by a substrate and having a magnetic material and a long axis, at least one magnet that produces a first magnetic field, which induces a magnetization in said magnetic material, said magnetization characterized by a magnetization vector pointing in a direction along said long axis of moveable element, wherein said first magnetic field is approximately perpendicular to a major central portion of said long axis, and a coil that produces a second magnetic field to switch said moveable element between first and second stable states, wherein only temporary application of said second magnetic field is required to change direction of said magnetization vector thereby causing said moveable element to switch between said first and second stable states;

wherein in said first stable state, said moveable element couples an electrical conductor in series with the signal; and wherein in said second stable state, said moveable element couples a corresponding circuit in series with the signal, wherein each said corresponding circuit is a capacitive circuit.

12. A method for controlling the coupling of a circuit into a signal path, comprising:

(A) producing a first magnetic field which induces a magnetization in a magnetic material of a moveable element, the magnetization characterized by a magnetization vector pointing in a direction along a longitudinal axis of the moveable element, the first magnetic field being approximately perpendicular to the longitudinal axis;

(B) producing a second magnetic field to switch the moveable element between a first stable state and a second stable state, wherein only temporary application of the second magnetic field is required to change direction of the magnetization vector thereby causing the moveable element to switch between the first stable state and the second stable state;

(C) controlling the moveable element to couple an electrical conductor in series with a signal when in the first stable state; and (D) controlling the moveable element to couple a circuit in series with the signal when in the second stable state, wherein step (D) comprises:

(1) controlling the moveable element to couple an attenuator circuit in series with the signal when in the second stable state.

13. The method of claim 12, wherein step (1) comprises:

controlling the moveable element to couple a resistive attenuator circuit in series with the signal when in the second stable state.

14. A method for controlling the coupling of a circuit into a signal path, comprising:

(A) producing a first magnetic field which induces a magnetization in a magnetic material of a moveable element, the magnetization characterized by a magnetization vector pointing in a direction along a longitudinal axis of the moveable element, the first magnetic field being approximately perpendicular to the longitudinal axis;

(B) producing a second magnetic field to switch the moveable element between a first stable state and a second stable state, wherein only temporary application of the second magnetic field is required to change direction of the magnetization vector thereby causing the moveable element to switch between the first stable state and the second stable state;

(C) controlling the moveable element to couple an electrical conductor in series with a signal when in the first stable state; and (D) controlling the moveable element to couple a circuit in series with the signal when in the second stable state, wherein step (D) comprises:

controlling the moveable element to couple a capacitive circuit in series with the signal when in the second stable state.

15. A method for controlling the coupling of a circuit into a signal path comprising:

(A) producing a first magnetic field which induces a magnetization in a magnetic material of a moveable element, the magnetization characterized by a magnetization vector pointing in a direction along a longitudinal axis of the moveable element, the first magnetic field being approximately perpendicular to the longitudinal axis;

(B) producing a second magnetic field to switch the moveable element between a first stable state and a second stable state, wherein only temporary application of the second magnetic field is required to change direction of the magnetization vector thereby causing the moveable element to switch between the first stable state and the second stable state;

(C) controlling the moveable element to couple an electrical conductor in series with a signal when in the first stable state; and (D) controlling the moveable element to couple a circuit in series with the signal when in the second stable state, wherein step (D) comprises:

controlling the moveable element to couple a filter circuit in series with the signal when in the second stable state.

16. A method for controlling the coupling of a circuit into a signal path, comprising:

(A) producing a first magnetic field which induces a magnetization in a magnetic material of a moveable element, the magnetization characterized by a magnetization vector pointing in a direction along a longitudinal axis of the moveable element, the first magnetic field being approximately perpendicular to the longitudinal axis;

(B) producing a second magnetic field to switch the moveable element between a first stable state and a second stable state, wherein only temporary application of the second magnetic field is required to change direction of the magnetization vector thereby causing the moveable element to switch between the first stable state and the second stable state;

(C) controlling the moveable element to couple an electrical conductor in series with a signal when in the first stable state; and (D) controlling the moveable element to couple a circuit in series with the signal when in the second stable state, wherein the moveable element comprises first and second electrically conductive portions, wherein step (C) comprises:

when in the first stable state, controlling the first electrically conductive portion to be coupled in series with the signal as the electrical conductor.

17. The method of claim 16, wherein step (D) comprises:

controlling the second electrically conductive portion to couple the circuit in series with the signal when in the second stable state.

18. A method for controlling the coupling of a circuit into a signal path, comprising:

(A) producing a first magnetic field which induces a magnetization in a magnetic material of a moveable element, the magnetization characterized by a magnetization vector pointing in a direction along a longitudinal axis of the moveable element, the first magnetic field being approximately perpendicular to the longitudinal axis;

(B) producing a second magnetic field to switch the moveable element between a first stable state and a second stable state, wherein only temporary application of the second magnetic field is required to change direction of the magnetization vector thereby causing the moveable element to switch between the first stable state and the second stable state;

(C) controlling the moveable element to couple an electrical conductor in series with a signal when in the first stable state; and (D) controlling the moveable element to couple a circuit in series with the signal when in the second stable state, wherein the moveable element comprises first, second, and third electrically conductive portions, wherein step (C) comprises:

when in the first stable state, controlling the first electrically conductive portion to be coupled in series with the signal as the electrical conductor.

19. The method of claim 18, wherein step (D) comprises:

controlling the second electrically conductive portion to couple a first signal line of the signal to an input to the circuit when in the second stable state; and controlling the third electrically conductive portion to couple a second signal line of the signal to an output of the circuit.

20. A device, comprising:

a plurality of circuit-coupling blocks that are serially coupled along a path of a signal, each circuit-coupling block comprising:

a moveable element supported by a substrate and having a magnetic material and a long axis, at least one magnet that produces a first magnetic field, which induces a magnetization in said magnetic material, said magnetization characterized by a magnetization vector pointing in a direction along said long axis of said moveable element, wherein said first magnetic field is approximately perpendicular to a major central portion of said long axis, and a coil that produces a second magnetic field to switch said moveable element between first and second stable states, wherein only temporary application of said second magnetic field is required to change direction of said magnetization vector thereby causing said moveable element to switch between said first and second stable states;

wherein in said first stable state, said moveable element couples an electrical conductor in series with the signal; and wherein in said second stable state, said moveable element couples a corresponding circuit in series with the signal, wherein each said corresponding circuit is a filter circuit.

21. A device, comprising:

a plurality of circuit-coupling blocks that are serially coupled along a path of a signal, each circuit-coupling block comprising:

a moveable element supported by a substrate and having a magnetic material and a long axis, at least one magnet that produces a first magnetic field, which induces a magnetization in said magnetic material, said magnetization characterized by a magnetization vector pointing in a direction along said long axis of said moveable element, wherein said first magnetic field is approximately perpendicular to a major central portion of said long axis, and a coil that produces a second magnetic field to switch said moveable element between first and second stable states, wherein only temporary application of said second magnetic field is required to change direction of said magnetization vector thereby causing said moveable element to switch between said first and second stable states;

wherein in said first stable state, said moveable element couples an electrical conductor in series with the signal; and wherein in said second stable state, said moveable element couples a corresponding circuit in series with the signal, wherein each said corresponding circuit is an attenuator circuit.

22. The apparatus of claim 21, wherein each said attenuator circuit is a resistive attenuator circuit.

23. A device, comprising:

a plurality of circuit-coupling blocks that are serially coupled along a path of a signal, each circuit-coupling block comprising:

a moveable element supported by a substrate and having a magnetic material and a long axis, at least one magnet that produces a first magnetic field, which induces a magnetization in said magnetic material, said magnetization characterized by a magnetization vector pointing in a direction along said long axis of said moveable element, wherein said first magnetic field is approximately perpendicular to a major central portion of said long axis, and a coil that produces a second magnetic field to switch said moveable element between first and second stable states, wherein only temporary application of said second magnetic field is required to change direction of said magnetization vector thereby causing said moveable element to switch between said first and second stable states;

wherein in said first stable state, said moveable element couples an electrical conductor in series with the signal; and wherein in said second stable state, said moveable element couples a corresponding circuit in series with the signal, wherein each said moveable element comprises first and second electrically conductive portions.

24. The apparatus of claim 23, wherein for each circuit-coupling block:

when in said first stable state, said first electrically conductive portion is coupled in series with the signal as said electrical conductor; and when in said second stable state, said second electrically conductive portion couples a first signal line of the signal to said circuit.

* * * * *